US009494368B2

(12) United States Patent
Jindou et al.

(10) Patent No.: US 9,494,368 B2
(45) Date of Patent: Nov. 15, 2016

(54) HEAT EXCHANGER AND AIR CONDITIONER

(71) Applicant: DAIKIN INDUSTRIES, LTD., Osaka-shi, Osaka (JP)

(72) Inventors: Masanori Jindou, Osaka (JP); Yoshio Oritani, Osaka (JP); Kousuke Morimoto, Osaka (JP); Tomohiko Sakamaki, Osaka (JP); Takuya Kazusa, Osaka (JP); Junichi Hamadate, Osaka (JP)

(73) Assignee: DAIKIN INDUSTRIES, LTD., Osaka-Shi (JP)

( * ) Notice: Subject to any disclaimer, the term of this patent is extended or adjusted under 35 U.S.C. 154(b) by 0 days.

(21) Appl. No.: 14/917,438

(22) PCT Filed: Sep. 11, 2014

(86) PCT No.: PCT/JP2014/004699
§ 371 (c)(1),
(2) Date: Mar. 8, 2016

(87) PCT Pub. No.: WO2015/037240
PCT Pub. Date: Mar. 19, 2015

(65) Prior Publication Data

US 2016/0223265 A1 Aug. 4, 2016

(30) Foreign Application Priority Data

Sep. 11, 2013 (JP) ..... 2013-188704

(51) Int. Cl.
*F28F 9/02* (2006.01)
*F28D 1/053* (2006.01)
(Continued)

(52) U.S. Cl.
CPC ..... *F28D 1/05375* (2013.01); *F24F 1/18* (2013.01); *F25B 39/00* (2013.01); *F28D 1/0417* (2013.01); *F28F 9/02* (2013.01); *F28F 9/22* (2013.01)

(58) Field of Classification Search
CPC .. F28D 1/05375; F28D 1/0417; F25B 39/00; F24F 1/18; F28F 9/02; F28F 9/22; F28F 9/26; F28F 9/0219
See application file for complete search history.

(56) References Cited

U.S. PATENT DOCUMENTS 5,752,566 A * 5/1998 Liu ..... F25B 39/04 165/110
2005/0006067 A1* 1/2005 Hoglinger ..... F28D 1/0443 165/140

(Continued)

FOREIGN PATENT DOCUMENTS

JP 8-145580 A 6/1996
JP 2005-510689 A 4/2005

(Continued)

*Primary Examiner* — Marc Norman
*Assistant Examiner* — Jon T Schermerhorn
(74) *Attorney, Agent, or Firm* — Birch, Stewart, Kolasch & Birch, LLP

(57) ABSTRACT

In a heat exchanger, a principal windward heat exchange region includes a principal windward bank portion, a principal leeward heat exchange region includes a principal leeward bank portion, an auxiliary windward heat exchange region includes an auxiliary windward bank portion, and an auxiliary leeward heat exchange region includes an auxiliary leeward bank portion. Each of the principal and auxiliary bank portions is constituted of a plurality of flat tubes. In the heat exchanger functioning as an evaporator, a refrigerant flows sequentially through the auxiliary windward, auxiliary leeward, principal leeward, and principal windward bank portions. In the heat exchanger functioning as a condenser, a refrigerant flows sequentially through the principal windward, principal leeward, auxiliary leeward, and auxiliary windward bank portions. Consequently, the heat exchanger exhibits performance sufficient for functioning as both an evaporator and a condenser.

20 Claims, 19 Drawing Sheets

(51) Int. Cl.

| | |
|---|---|
| ***F24F 1/18*** | (2011.01) |
| ***F25B 39/00*** | (2006.01) |
| ***F28F 9/22*** | (2006.01) |
| ***F28D 1/04*** | (2006.01) |

(56) References Cited

U.S. PATENT DOCUMENTS

2007/0131398 A1* 6/2007 Ichiyanagi ..... F28D 1/05375 165/153
2007/0144721 A1* 6/2007 Watanabe ..... F28D 1/05375 165/174
2008/0164015 A1* 7/2008 Papapanu ..... F28D 1/05375 165/176
2014/0137592 A1* 5/2014 Matsumoto ..... F25B 39/00 62/324.6
2014/0338874 A1 11/2014 Jindou et al.
2015/0276280 A1* 10/2015 Furui ..... F25B 13/00 62/160

FOREIGN PATENT DOCUMENTS

JP 2007-147273 A 6/2007
JP 2011-208913 A 10/2011
JP 2012-167880 A 9/2012
JP 2013-61091 A 4/2013
JP 2013-137193 A 7/2013

* cited by examiner

HEAT EXCHANGER AND AIR CONDITIONER

TECHNICAL FIELD

The present invention relates to a heat exchanger including flat tubes and fins and allowing a refrigerant and air to exchange heat.

BACKGROUND ART

Conventionally, a heat exchanger including flat tubes and fins and allowing a refrigerant and air to exchange heat has been known. Patent Document 1 (see FIG. 3) discloses a single-column heat exchanger having a single tube bank comprised of flat tubes arranged in line. Patent Document 2 (see FIG. 2) and Patent Document 3 (see FIG. 22) disclose a double-column heat exchanger having two tube banks, each of which is comprised of flat tubes arranged in line. In the heat exchanger disclosed in Patent Document 2, independent flat tubes are arranged in two lines to constitute the two tube banks. On the other hand, in the heat exchanger of Patent Document 3, U-shaped flat tubes, each of which is bent at the middle thereof, are arranged to constitute the two tube banks. Also, in each of the heat exchangers disclosed in Patent Documents 1-3, a header is connected to end portions of the flat tubes, and the refrigerant flowed into the header is divided to flow into the plurality of flat tubes.

CITATION LIST

Patent Document

Patent Document 1: Japanese Unexamined Patent Publication No. 2013-137193

Patent Document 2: Japanese Unexamined Patent Publication (Japanese Translation of PCT Application) No. 2005-510689

Patent Document 3: Japanese Unexamined Patent Publication No. H08-145580

SUMMARY OF THE INVENTION

Technical Problem

By the way, the performance of a heat exchanger allowing air and a refrigerant to exchange heat varies depending on a refrigerant flow path in the heat exchanger. In particular, in the heat exchanger having a double-column structure, the problem is which one of the windward or leeward tube banks the refrigerant first flows into.

In general, regarding a heat exchanger used as an evaporator, it has been considered that the refrigerant preferably flows from the windward tube bank to the leeward tube bank in this order. However, if the heat exchanger having the structure disclosed in Patent Document 1 (i.e., the heat exchanger configured such that the refrigerant that flowed into the header is distributed to the plurality of flat tubes arranged one above the other) is configured to have a double-column structure, and the refrigerant flows from the windward tube bank to the leeward tube bank in this order, the heat exchanger may possibly fail to exhibit adequate performance in functioning an evaporator.

A reason for this phenomenon will be described with reference to FIGS. 18-20. The temperatures of air and a refrigerant shown in FIGS. 18 and 20 are examples in the case where a heat exchanger (500) is used as an outdoor heat exchanger of an air conditioner.

If a gas-liquid two-phase refrigerant flows into flat tubes (501) with uniform wetness, the temperatures of the refrigerant and air in the heat exchanger (500) varies as shown in FIG. 18.

Specifically, the temperature (the saturation temperature) of the refrigerant flowing through the windward tube bank (502) decreases from 2° C. to 1° C. due to a pressure loss caused when the refrigerant passes through the flat tubes (501). On the other hand, the air passing through the heat exchanger (500) exchanges heat with the refrigerant flowing in the windward tube bank (502), and has its temperature decreased from 7° C. to 3° C. Also, the temperature (the saturation temperature) of the refrigerant flowing through the leeward tube bank (503) decreases from 1° C. to 0° C. due to a pressure loss caused when the refrigerant passes through the flat tubes (501), and the refrigerant exchanges heat with the air at 3° C. that passed through the windward tube bank (502). Then, the refrigerant that has turned into a gas single phase state in the flat tubes (501) constituting the leeward tube bank (503) is turned into a superheated state by absorbing heat from the air passed through the windward tube bank (502).

If the wetness of the gas-liquid two-phase refrigerant flowing into each of the flat tubes (501) is uniform as described above, the temperature difference between the refrigerant and the air in both of the tube banks (502, 503) is secured and the amount of heat exchanged between the refrigerant and the air in the heat exchanger (500) is fully secured, because, in the leeward tube bank (503), the refrigerant having its temperature decreased due to a pressure loss caused when the refrigerant passes through the windward tube bank (502) exchanges heat with the air cooled by the refrigerant flowing in the windward tube bank (502).

However, if the gas-liquid two-phase refrigerant that flowed into the space in the header elongated in the vertical direction is distributed to the plurality of flat tubes (501) communicating with the header space and arranged one above the other, the higher the level of the flat tube (501) is, the more the wetness of the refrigerant flowing into the flat tube (501) decreases because the density of the liquid refrigerant is higher than that of the gas refrigerant. Accordingly, the higher the level of the flat tube (501) is, the more the mass flow rate of the refrigerant flowing thereinto decreases.

Thus, as illustrated in FIG. 19, in an upper portion of the heat exchanger (500) into which the refrigerant having a low wetness flows, the refrigerant might be turned into a gas single phase state in the windward tube bank (502). That is, a region where the superheated gas refrigerant flows in the flat tubes (501) (i.e., a superheated region (504) dotted as shown in FIG. 19) might be formed in the windward tube bank (502).

In the portion of the heat exchanger (500) where the refrigerant is turned into a gas single phase state in the windward tube bank (502), the temperatures of the refrigerant and air vary as shown in FIG. 20.

Specifically, the gas-liquid two-phase refrigerant at 2° C. that flowed into the windward tube bank (502) is turned into a gas single phase state therein, and has its temperature raised to 6° C. at the exit of the windward tube bank (502). On the other hand, although the air passed through the portion of the windward tube bank (502) where the gas-liquid two-phase refrigerant flows has its temperature decreased from 7° C. to 3° C., the air passed through the portion where the gas single phase refrigerant flows has its temperature hardly decreased. The gas single phase refrigerant at 6° C. flows into the leeward tube bank (503). The air that passed through the portion of the windward tube bank (502), where the gas single phase refrigerant flows, flows into the front part of the leeward tube bank (503). Thus, the temperature of the refrigerant hardly varies while the refrigerant passes through the front part of the leeward tube bank (503). In addition, the air at 3° C. that passed through the portion of the windward tube bank (502), where the gas-liquid two-phase refrigerant flows, flows into the rear part of the leeward tube bank (503). Thus, the refrigerant dissipates heat to the air, and the temperature of the refrigerant decreases from 6° C. to 5° C.

If the gas-liquid two-phase refrigerant flowed in the space in the header elongated in the vertical direction is distributed to the plurality of flat tubes (501) communicating with the space and arranged one above the other as described above, the superheated region (504) is formed in the windward tube bank (502), and the portion of the leeward tube bank (503) positioned on the leeward of the superheated region (504) hardly functions as an evaporator. Thus, the heat exchanger (500) may possibly fail to exhibit sufficient performance.

On the other hand, in the heat exchanger (500) used as a condenser, the refrigerant preferably flows from the leeward tube bank (503) to the windward tube bank (502) in this order. This is because the refrigerant condensed and turned into a liquid single phase state can exchange heat with the air immediately after being sent to the heat exchanger (500) (i.e., the air before having its temperature increased), and the liquid refrigerant can be securely subcooled.

However, generally, in the heat exchanger (500) used as an outdoor heat exchanger of the air conditioner, the direction of a refrigerant flow path is reversed between when the heat exchanger (500) functions as an evaporator and when the heat exchanger (500) functions as a condenser. Thus, if the heat exchanger (500) is configured such that the refrigerant flows from the leeward tube bank (503) to the windward tube bank (502) in this order when the heat exchanger (500) functions as a condenser, the refrigerant flows from the windward tube bank (502) to the leeward tube bank (503) in this order when the heat exchanger (500) functions an evaporator. As can be seen from the foregoing, if the heat exchanger having the structure disclosed in the Patent Document 1 (i.e., the heat exchanger having the structure where the refrigerant flowed into the header is distributed to the plurality of flat tubes arranged one above the other) is configured to have a double-column structure, and the refrigerant flows from the windward tube bank to the leeward tube bank in this order, the heat exchanger may possibly fail to exhibit sufficient performance in functioning as an evaporator.

As can be seen from the foregoing, if the heat exchanger having the structure where the refrigerant flowed into the header is distributed to the plurality of flat tubes arranged one above the other is configured to have the double-column structure, it is difficult to have both of performance as an evaporator and performance as a condenser.

In view of the foregoing, it is an object of the present invention to provide a double-column heat exchanger including a plurality of flat tubes arranged one above the other, and achieving both of performance as an evaporator and performance as a condenser.

Solution to the Problem

The first aspect of this disclosure is directed to a heat exchanger configured to exchange heat between a refrigerant flowing through a plurality of flat tubes (31, 61) and air. The heat exchanger includes: a windward tube bank (50) and a leeward tube bank (90) arranged in a flow direction of the air, each of which being constituted of the plurality of flat tubes (31, 61) arranged one above the other; and fins (32, 62) jointed to the flat tubes (31, 61). The windward tube bank (50) is divided into a principal windward bank portion (51) and an auxiliary windward bank portion (54), each of which being constituted of the plurality of the flat tubes (31) arranged one above the other. The auxiliary windward bank portion (54) is positioned below the principal windward bank portion (51), and is constituted of the flat tubes (31) smaller in number than the flat tubes (31) of the principal windward bank portion (51). The leeward tube bank (90) is divided into a principal leeward bank portion (91) and an auxiliary leeward bank portion (94), each of which being constituted of the plurality of flat tubes (61) arranged one above the other. The auxiliary leeward bank portion (94) is positioned below the principal leeward bank portion (91), and is constituted of the flat tubes (61) smaller in number than the flat tubes (61) of the principal leeward bank portion (91). The heat exchanger further includes a header collecting pipe (70) connected to one end of each of the flat tubes (61) constituting the principal leeward bank portion (91) to form principal communicating spaces (75*a*-75*f*) communicating with the plurality of flat tubes (61). The auxiliary windward bank portion (54), the auxiliary leeward bank portion (94), the header collecting pipe (70), the principal leeward bank portion (91), and the principal windward bank portion (51) are arranged in series in a refrigerant flow path. The refrigerant flows from the auxiliary windward bank portion (54) to the principal windward bank portion (51) in this order when the heat exchanger functions as an evaporator. The refrigerant flows from the principal windward bank portion (51) to the auxiliary windward bank portion (54) in this order when the heat exchanger functions as a condenser.

In the first aspect, the heat exchanger (23) is provided with the windward and leeward tube banks (50) and (90). Each of the windward and leeward tube banks (50) and (90) is constituted of the plurality of flat tubes (31, 61) arranged one above the other. In the flow direction of air passing through the heat exchanger (23), the leeward tube bank (90) is arranged downstream of the windward tube bank (50). The windward tube bank (50) is divided into the principal windward bank portion (51) and the auxiliary windward bank portion (54), and the leeward tube bank (90) is divided into the principal leeward bank portion (91) and the auxiliary leeward bank portion (94).

When the heat exchanger (23) of the first aspect functions an evaporator, the refrigerant passes through the flat tubes (31) constituting the auxiliary windward bank portion (54), the flat tubes (61) constituting the auxiliary leeward bank portion (94), the principal communicating spaces (75*a*-75*f*) in the header collecting pipe (70), the flat tubes (61) constituting the principal leeward bank portion (91), and the flat tubes (31) constituting the principal windward bank portion (51) in this order. The changes in temperatures of air and refrigerant in the heat exchanger (23) of this aspect is shown in FIG. 10. The values of the temperatures shown in FIG. 10 are merely examples.

As illustrated in FIG. 10, a gas-liquid two-phase refrigerant having a saturation temperature of 2° C. flows into the flat tubes (31) constituting the auxiliary windward bank portion (54). The saturation temperature (the evaporation temperature) of the refrigerant gradually decreases to 0° C. due to a pressure loss caused when the refrigerant passes through the flat tubes (31, 61). Then, the refrigerant is turned into a gas single phase state while passing through the flat tubes (31) constituting the principal windward bank portion (51), and then the refrigerant having an increased temperature of 1° C. flows out of the flat tubes (31) constituting the principal windward bank portion (51). On the other hand, air at 7° C. flows into the auxiliary windward bank portion (54) and the principal windward bank portion (51), air cooled to 4° C. in passing through the auxiliary windward bank portion (54) flows into the auxiliary leeward bank portion (94), and air cooled to 3° C. in passing through the principal windward bank portion (51) flows into the principal leeward bank portion (91).

Thus, when the heat exchanger (23) of the first aspect functions as an evaporator, the refrigerant has a lower temperature than the air in the entirety of the heat exchanger (23), and the amount of heat that the refrigerant absorbs from the air (i.e., the amount of heat absorbed by the refrigerant) is secured.

Here, when the heat exchanger (23) of the first aspect functions an evaporator, the refrigerant that has passed through the flat tubes (61) constituting the auxiliary leeward bank portion (94) temporarily flows into the principal communicating spaces (75*a*-75*f*) formed by the header collecting pipe (70), and thereafter is distributed to the plurality of flat tubes (61) constituting the principal leeward bank portion (91) (i.e., the plurality of flat tubes (61) arranged one above the other). During this time, the refrigerant flowing into the flat tubes (61) constituting the principal leeward bank portion (91) does not necessarily have a uniform wetness, and the refrigerant having a low wetness might flow into part of the flat tubes (61).

However, the air exchanging heat with the refrigerant passing through the principal leeward bank portion (91) has been already cooled by the refrigerant passing through the principal windward bank portion (51). Thus, the temperature difference between the refrigerant and the air in the principal leeward bank portion (91) is smaller than that in the principal windward bank portion (51). Accordingly, even in part of the flat tubes (61) of the principal leeward bank portion (91) into which the refrigerant having a low wetness flows, such a refrigerant generally remains as a gas-liquid two-phase refrigerant through the entire length of the flat tubes (61). Consequently, as can be seen from the foregoing, in the entirety of the heat exchanger (23) of the first aspect functioning as an evaporator, the refrigerant has a lower temperature than the air.

Also, when the heat exchanger (23) of the first aspect functions as a condenser, the refrigerant passes through the flat tubes (31) constituting the principal windward bank portion (51), the flat tubes (61) constituting the principal leeward bank portion (91), the principal communicating spaces (75*a*-75*f*) in the header collecting pipe (70), the flat tubes (61) constituting the auxiliary leeward bank portion (94), and the flat tubes (31) constituting the auxiliary windward bank portion (54) in this order. The changes in temperatures in the air and refrigerant in the heat exchanger (23) of this aspect are shown in FIG. 11. The values of the temperatures shown in FIG. 11 are merely examples.

As illustrated in FIG. 11, a superheated gas refrigerant at 55° C. flows into the flat tubes (31) constituting the principal windward bank portion (51). This refrigerant is turned into a saturated gas refrigerant at 50° C. in the flat tubes (31) constituting the principal windward bank portion (51), and thereafter condenses gradually. The saturation temperature (the condensation temperature) of the refrigerant gradually decreases to 49° C. due to a pressure loss caused when the refrigerant passes through the flat tubes (31, 61). Then, the refrigerant is turned into a liquid single phase state in the flat tubes (61) constituting the auxiliary leeward bank portion (94), and then the refrigerant having a decreased temperature of 42° C. flows out of the flat tubes (31) constituting the auxiliary windward bank portion (54). On the other hand, air at 35° C. flows into the auxiliary windward bank portion (54) and the principal windward bank portion (51), air heated to 45° C. in passing through the principal windward bank portion (51) flows into the principal leeward bank portion (91), and air heated to 40° C. in passing through the auxiliary windward bank portion (54) flows into the auxiliary leeward bank portion (94).

As can be seen from the foregoing, when the heat exchanger (23) of the first aspect functions a condenser, the refrigerant has a higher temperature than the air in the entirety of the heat exchanger (23), and the amount of heat that the refrigerant dissipates to the air (i.e., the amount of heat dissipated by the refrigerant) is secured.

A second aspect of this disclosure is an embodiment of the first aspect. In the second aspect, the number of the flat tubes (31) constituting the principal windward bank portion (51) is equal to the number of the flat tubes (61) constituting the principal leeward bank portion (91), and the number of the flat tubes (31) constituting the auxiliary windward bank portion (54) is equal to the number of the flat tubes (61) constituting the auxiliary leeward bank portion (94).

In the second aspect, the principal windward bank portion (51) and the principal leeward bank portion (91) are constituted of the flat tubes (31, 61), respectively, of which the numbers are equal to each other. The auxiliary windward bank portion (54) and the auxiliary leeward bank portion (94) are constituted of the flat tubes (31, 61), respectively, of which the numbers are equal to each other.

A third aspect of this disclosure is an embodiment of the first or second aspect. In the third aspect, the principal windward bank portion (51) is further divided into a plurality of principal windward bank blocks (52*a*-52*f*), each of which being constituted of the plurality of the flat tubes (31) arranged one above the other. The principal leeward bank portion (91) is further divided into a plurality of principal leeward bank blocks (92*a*-92*f*), each of which being constituted of the plurality of flat tubes (61) arranged one above the other. The number of the principal windward bank blocks (52*a*-52*f*) is equal to the number of the principal leeward bank blocks (92*a*-92*f*). The principal windward bank blocks (52*a*-52*f*) and the principal leeward bank blocks (92*a*-92*f*) form mutually different pairs, in each of which the principal windward bank block (52*a*-52*f*) and the principal leeward bank block (92*a*-92*f*) are arranged in series in the refrigerant flow path.

In the third aspect, the plurality of principal windward bank blocks (52*a*-52*f*) and the plurality of principal leeward bank blocks (92*a*-92*f*) form mutually different pairs. When the heat exchanger (23) functions as an evaporator, the refrigerant passed through the flat tubes (61) of the principal leeward bank block (92*a*-92*f*) flows into the flat tubes (31) of the principal windward bank block (52*a*-52*f*) in each of the mutually different pairs. On the other hand, when the heat exchanger (23) functions as a condenser, the refrigerant passed through the flat tubes (31) of the principal windward bank block (52*a*-52*f*) flows into the flat tubes (61) of the principal leeward bank block (92*a*-92*f*) in each of the mutually different pairs.

A fourth aspect of this disclosure is an embodiment of the third aspect. In the fourth aspect, in each of the mutually different pairs, the number of the flat tubes (31) constituting the principal windward bank block (52*a*-52*f*) is equal to the number of the flat tubes (61) constituting the principal leeward bank block (92*a*-92*f*).

In the fourth aspect, the principal windward bank block (52*a*-52*f*) and the principal leeward bank block (92*a*-92*f*) in each of the mutually different pairs are constituted of the same number of the flat tubes (31, 61). For example, the first principal windward bank block (52*a*) and the first principal leeward bank block (92*a*) in each of the mutually different pairs are constituted of the same number of the flat tubes (31, 61). The second principal windward bank block (52*b*) and the second principal leeward bank block (92*b*) in each of the mutually different pairs are constituted of the same number of the flat tubes (31, 61). However, the number of the flat tubes (31) constituting the first principal windward bank block (52*a*) is not necessarily equal to that of the flat tubes (31) constituting the second principal windward bank block (52*b*).

A fifth aspect of this disclosure is an embodiment of the fourth aspect. In the fifth aspect, in each of the mutually different pairs, the flat tubes (31) constituting the principal windward bank block (52*a*-52*f*) and the flat tubes (61) constituting the principal leeward bank block (92*a*-92*f*) are individually connected one by one.

In the fifth aspect, the flat tubes (31) of the principal windward bank block (52*a*-52*f*) and the flat tubes (61) of the principal leeward bank block (92*a*-92*f*) in each of the mutually different pairs are individually connected one by one. When the heat exchanger (23) functions an evaporator, the refrigerant that has passed through one of the flat tubes (61) of the principal leeward bank block (92*a*-92*f*) flows into one of the flat tubes (31) of the principal windward bank block (52*a*-52*f*) connected to the flat tube (61) in each of the mutually different pairs. On the other hand, when the heat exchanger (23) functions a condenser, the refrigerant that has passed through one of the flat tubes (31) of the principal windward bank block (52*a*-52*f*) flows into one of the flat tubes (61) of the principal leeward bank block (92*a*-92*f*) connected to the flat tube (31) in each of the mutually different pairs.

Here, the heat exchanger may have a structure in which all the flat tubes (31) constituting the principal windward bank blocks (52*a*-52*f*) and all the flat tubes (61) constituting the principal leeward bank blocks (92*a*-92*f*) communicate with one space so that each of the principal windward bank blocks (52*a*-52*f*) and the associated one of the principal leeward bank blocks (92*a*-92*f*) paired with each other are arranged in series in the refrigerant flow path. However, when such a structure is adopted, and the refrigerant flows from one of the pair of the principal windward bank block (52*a*-52*f*) and the principal leeward bank block (92*a*-92*f*) to the other, flows of the refrigerant that have passed through the plurality of flat tubes (31, 61) constituting the one of the pair temporarily merge together, and then flow separately into the plurality of flat tubes (61, 31) constituting the other one of the pair. Thus, the mass flow rate of the refrigerant flowing into the plurality of flat tubes (61, 31) constituting the other one of the pair might be nonuniform.

In contrast, in the fifth aspect, the flat tubes (31) constituting the principal windward bank block (52*a*-52*f*) and the flat tubes (61) constituting the principal leeward bank block (92*a*-92*f*) in each of the mutually different pairs are individually connected one by one. Thus, when the refrigerant flows from one of the principal windward bank block (52*a*-52*f*) and the principal leeward bank block (92*a*-92*f*) to the other, it is not necessary to redistribute the refrigerant to the plurality of flat tubes (31, 61) in the process.

A sixth aspect of this disclosure is an embodiment of any one of the third to fifth aspects. In the sixth aspect, the header collecting pipe (70) is formed with as many the principal communicating spaces (75*a*-75*f*) as the principal leeward bank blocks (92*a*-92*f*). The principal communicating spaces (75*a*-75*f*) and the principal leeward bank blocks (92*a*-92*f*) form mutually different pairs, in each of which the principal communicating space (75*a*-75*f*) communicates with the flat tubes (61) constituting the principal leeward bank block (92*a*-92*f*).

In the sixth aspect, the plurality of principal communicating spaces (75*a*-75*f*) formed in the header collecting pipe (70) and the principal leeward bank blocks (92*a*-92*f*) form mutually different pairs. When the heat exchanger (23) functions as an evaporator, the refrigerant flows into each of the principal communicating spaces (75*a*-75*f*) of the header collecting pipe (70), and then is diverged into the plurality of flat tubes (61) of one of the principal leeward bank blocks (92*a*-92*f*) associated with the principal communicating spaces (75*a*-75*f*).

A seventh aspect of this disclosure is an embodiment of the first or second aspect. In the seventh aspect, the auxiliary windward bank portion (54) is further divided into a plurality of auxiliary windward bank blocks (55*a*-55*c*), each of which being constituted of the plurality of the flat tubes (31) arranged one above the other. The auxiliary leeward bank portion (94) is further divided into a plurality of auxiliary leeward bank blocks (95*a*-95*c*), each of which being constituted of the plurality of flat tubes (61) arranged one above the other. The number of the auxiliary windward bank blocks (55*a*-55*c*) is equal to the number of the auxiliary leeward bank blocks (95*a*-95*c*). The auxiliary windward bank blocks (55*a*-55*c*) and the auxiliary leeward bank blocks (95*a*-95*c*) form mutually different pairs. The auxiliary windward bank block (55*a*-55*c*) and the auxiliary leeward bank block (95*a*-95*c*) in each of the mutually different pairs are arranged in series in the refrigerant flow path.

In the seventh aspect, the plurality of auxiliary windward bank blocks (55*a*-55*c*) and the auxiliary leeward bank blocks (95*a*-95*c*) form mutually different pairs. When the heat exchanger (23) functions as an evaporator, the refrigerant that passed through the flat tubes (31) of each of the auxiliary windward bank blocks (55*a*-55*c*) flows into the flat tubes (61) of one of the auxiliary leeward bank blocks (95*a*-95*c*) associated with the auxiliary windward bank blocks (55*a*-55*c*). On the other hand, when the heat exchanger (23) functions as a condenser, the refrigerant that passed through the flat tubes (61) of each of the auxiliary leeward bank blocks (95*a*-95*c*) flows into the flat tubes (31) of one of auxiliary windward bank blocks (55*a*-55*c*) associated with the auxiliary leeward bank blocks (95*a*-95*c*).

An eighth aspect of this disclosure is an embodiment of the seventh aspect. In the eighth aspect, in each of the mutually different pairs, the number of the flat tubes (31) constituting the auxiliary windward bank block (55*a*-55*c*) is equal to the number of the flat tubes (61) constituting the auxiliary leeward bank block (95*a*-95*c*).

In the eighth aspect, each of the auxiliary windward bank blocks (55*a*-55*c*) and the auxiliary leeward bank blocks (95*a*-95*c*) forming the mutually different pairs is constituted of the flat tubes (31, 61) of which the numbers are equal to each other. For example, the first auxiliary windward bank block (55*a*) and the first auxiliary leeward bank block (95*a*) paired with each other are constituted of the flat tubes (31, 61), respectively, of which the numbers are equal to each other. The second auxiliary windward bank block (55*b*) and the second auxiliary leeward bank block (95*b*) paired with each other are constituted of the flat tubes (31, 61), respectively, of which the numbers are equal to each other. However, the number of the flat tubes (31) constituting the first auxiliary windward bank block (55*a*) is not necessarily equal to that of the flat tubes (31) constituting the second auxiliary windward bank block (55*b*).

A ninth aspect of this disclosure is an embodiment of the eighth aspect. In the ninth aspect, in each of the mutually different pairs, the flat tubes (31) constituting the auxiliary windward bank block (55*a*-55*c*) and the flat tubes (61) constituting the auxiliary leeward bank block (95*a*-95*c*) are individually connected one by one.

In the ninth aspect, in each of the mutually different pairs of the auxiliary windward bank blocks (55*a*-55*c*) and the auxiliary leeward bank blocks (95*a*-95*c*), the flat tubes (31) of the auxiliary windward bank block (55*a*-55*c*) and the flat tubes (61) of the auxiliary leeward bank block (95*a*-95*c*) are individually connected one by one. When the heat exchanger (23) functions as an evaporator, in the auxiliary windward bank block (55*a*-55*c*) and the auxiliary leeward bank block (95*a*-95*c*) paired with each other, the refrigerant that has passed through one of the flat tubes (31) of the auxiliary windward bank block (55*a*-55*c*) flows into one of the flat tubes (61) of the auxiliary leeward bank block (95*a*-95*c*) connected to the one of the flat tubes (31). On the other hand, when the heat exchanger (23) functions as a condenser, in the auxiliary windward bank block (55*a*-55*c*) and the auxiliary leeward bank block (95*a*-95*c*) paired with each other, the refrigerant that has passed through one of the flat tubes (61) of the auxiliary leeward bank block (95*a*-95*c*) flows into one of the flat tubes (31) of the auxiliary windward bank block (55*a*-55*c*) connected to the one of the flat tubes (61).

Here, the heat exchanger (23) may have a structure in which all the flat tubes (31) constituting the auxiliary windward bank blocks (55*a*-55*c*) and all the flat tubes (61) constituting the auxiliary leeward bank blocks (95*a*-95*c*) communicate with one space so that each of the auxiliary windward bank blocks (55*a*-55*c*) and the associated one of the auxiliary leeward bank blocks (95*a*-95*c*) paired with each other are arranged in series in the refrigerant flow path. However, when such a structure is adopted, and the refrigerant flows from one of the pair of the auxiliary windward bank block (55*a*-55*c*) and the auxiliary leeward bank block (95*a*-95*c*) to the other, flows of the refrigerant that have passed through the plurality of flat tubes (31, 61) constituting the one of the auxiliary windward bank block (55*a*-55*c*) and the auxiliary leeward bank block (95*a*-95*c*) temporarily merge together, and then flow separately into the plurality of flat tubes (61, 31) constituting the other one of the pair. Thus, the mass flow rate of the refrigerant flowing into the plurality of flat tubes (61, 31) constituting the other one of the pair might be nonuniform.

In contrast, in the ninth aspect, the flat tubes (31) of the auxiliary windward bank block (55*a*-55*c*) and the flat tubes (61) of the auxiliary leeward bank block (95*a*-95*c*) in each of the mutually different pairs are individually connected one by one. Thus, when the refrigerant flows from one of the pair of the auxiliary windward bank block (55*a*-55*c*) and the auxiliary leeward bank block (95*a*-95*c*) to the other, it is not necessary to redistribute the refrigerant to the plurality of flat tubes (31, 61) in the process.

A tenth aspect of this disclosure is an embodiment of any one of the seventh to ninth aspects. In the tenth aspect, the header collecting pipe (70) is further formed with a plurality of auxiliary communicating spaces (77*a*-77*c*) each communicating with the flat tubes (61) constituting the auxiliary leeward bank portion (94). The number of the auxiliary communicating spaces (77*a*-77*c*) is equal to the number of the auxiliary leeward bank blocks (95*a*-95*c*). Each of the auxiliary leeward bank blocks (95*a*-95*c*) is paired with an associated one of the auxiliary communicating spaces (77*a*-77*c*). In each of the pairs of the auxiliary communicating spaces (77*a*-77*c*) and the auxiliary leeward bank blocks (95*a*-95*c*), the auxiliary communicating space (77*a*-77*c*) communicates with the flat tubes (61) constituting the auxiliary leeward bank block (95*a*-95*c*).

In the tenth aspect, in addition to the principal communicating spaces (75*a*-75*f*), the header collecting pipe (70) is further formed with the auxiliary communicating spaces (77*a*-77*c*). The plurality of auxiliary communicating spaces (77*a*-77*c*) formed in the header collecting pipe (70) and the auxiliary leeward bank blocks (95*a*-95*c*) form mutually different pairs. When the heat exchanger (23) functions as a condenser, the refrigerant flows into each of the auxiliary communicating spaces (77*a*-77*c*) of the header collecting pipe (70), and then flows separately into the plurality of flat tubes (61) of one of the auxiliary leeward bank blocks (95*a*-95*c*) associated with the each of the auxiliary communicating spaces (77*a*-77*c*).

An eleventh aspect of this disclosure is an embodiment of the first or second aspect. In the eleventh aspect, the principal leeward bank portion (91) is further divided into a plurality of principal leeward bank blocks (92*a*-92*f*), each of which being constituted of the plurality of flat tubes (61) arranged one above the other. The auxiliary leeward bank portion (94) is further divided into the plurality of auxiliary leeward bank blocks (95*a*-95*c*), each of which being constituted of the plurality of flat tubes (61) arranged one above the other. The header collecting pipe (70) is formed with as many the principal communicating spaces (75*a*-75*f*) as the principal leeward bank blocks (92*a*-92*f*). The principal communicating spaces (75*a*-75*f*) and the principal leeward bank blocks (92*a*-92*f*) form mutually different pairs, in each of which the principal communicating space (75*a*-75*f*) communicates with the flat tubes (61) constituting the principal leeward bank block (92*a*-92*f*).

In the eleventh aspect, the principal leeward bank portion (91) is divided into the plurality of principal leeward bank blocks (92*a*-920, and the auxiliary leeward bank portion (94) is divided into the plurality of auxiliary leeward bank blocks (95*a*-95*c*). Each of the principal leeward bank blocks (92*a*-92*f*) and each of the auxiliary leeward bank blocks (95*a*-95*c*) are constituted of the plurality of flat tubes (61) arranged one above the other. The plurality of principal communicating spaces (75*a*-750 formed in the header collecting pipe (70) and the principal leeward bank blocks (92*a*-92*f*) form mutually different pairs. When the heat exchanger (23) functions as an evaporator, the refrigerant flows into the principal communicating space (75*a*-75*f*) of the header collecting pipe (70), and then flows separately into the plurality of flat tubes (61) of the principal leeward bank block (92*a*-92*f*) in each of the mutually different pairs.

A twelfth aspect of this disclosure is an embodiment of the eleventh aspect. In the twelfth aspect, the principal leeward bank portion (91) is formed with principal leeward bank block groups (93*a*-93*c*), each of which being constituted of the plurality of principal leeward bank blocks (92*a*-92*f*). The number of the principal leeward bank block groups (93*a*-93*c*) is equal to the number of the auxiliary leeward bank blocks (95*a*-95*c*). The principal leeward bank block groups (93*a*-93*c*) and the auxiliary leeward bank blocks (95*a*-95*c*) form mutually different pairs. In each of the mutually different pairs, the auxiliary leeward bank block (95*a*-95*c*) is connected to the principal communicating space (75*a*-75*f*) associated with the principal leeward bank block (92*a*-92*f*) of the principal leeward bank block group (93*a*-93*c*).

In the twelfth aspect, the principal leeward bank portion (91) is formed with as many the principal leeward bank block groups (93*a*-93*c*) as the auxiliary leeward bank blocks (95*a*-95*c*). Each of the principal leeward bank block groups (93*a*-93*c*) is constituted of the plurality of principal leeward bank blocks (92*a*-92*f*). Each of the principal communicating spaces (75*a*-75*f*) paired with the principal leeward bank blocks (92*a*-92*f*) constituting each of the principal leeward bank block groups (93*a*-93*c*) (i.e., the plurality of principal communicating spaces (75*a*-75*f*)) are connected to one of the auxiliary leeward bank blocks (95*a*-95*c*) paired with the each of the principal leeward bank block groups (93*a*-93*c*). When the heat exchanger (23) functions as an evaporator, the refrigerant that has passed through each of the auxiliary leeward bank blocks (95*a*-95*c*) flows separately into the plurality of principal communicating spaces (75*a*-75*f*) connected with the auxiliary leeward bank blocks (95*a*-95*c*), and then flows separately into the plurality of flat tubes (61) constituting the principal leeward bank blocks (92*a*-92*f*) paired with the principal communicating spaces (75*a*-75*f*) into which the refrigerant has flowed.

A thirteenth aspect of this disclosure is an embodiment of the twelfth aspect. In the thirteenth aspect, the plurality of principal leeward bank blocks (92*a*-92*f*) constituting each of the principal leeward bank block groups (93*a*-93*c*) are vertically adjacent to each other.

In the thirteenth aspect, the plurality of principal leeward bank blocks (92*a*-92*f*) vertically adjacent to each other constitute one principal leeward bank block group (93*a*-93*c*).

A fourteenth aspect of this disclosure is an embodiment of the eleventh aspect. In the fourteenth aspect, the number of the principal leeward bank blocks (92*a*-921) is equal to the number of the auxiliary leeward bank blocks (95*a*-95*f*). The principal leeward bank blocks (92*a*-92*f*) and the auxiliary leeward bank blocks (95*a*-95*f*) form mutually different pairs, in each of which the principal leeward bank block (92*a*-92*f*) and the auxiliary leeward bank block (95*a*-95*f*) are arranged in series in the refrigerant flow path.

In the fourteenth aspect, the number of the principal leeward bank blocks (92*a*-92*f*) is equal to that of the auxiliary leeward bank blocks (95*a*-95*f*). The plurality of principal leeward bank blocks (92*a*-92*f*) and the auxiliary leeward bank blocks (95*a*-95*f*) form mutually different pairs. The principal leeward bank block (92*a*-92*f*) and the auxiliary leeward bank block (95*a*-95*f*) paired with each other are arranged in series in the refrigerant flow path. Accordingly, when the heat exchanger (23) functions as an evaporator, the refrigerant that has passed through the flat tubes (61) of each of the auxiliary leeward bank blocks (95*a*-95*f*) flows into the flat tubes (61) of the associated one of the principal leeward bank blocks (92*a*-92*f*).

A fifteenth aspect of this disclosure is directed to an air conditioner (10), which includes a refrigerant circuit (20) provided with the heat exchanger (23) of any one of the first to thirteenth aspects, and a refrigerating cycle is performed by circulating a refrigerant in the refrigerant circuit (20).

In the fifteenth aspect, the heat exchanger (23) of any one of the first to fourteenth aspects is connected to the refrigerant circuit (20). In the heat exchanger (23), the refrigerant circulating in the refrigerant circuit (20) exchanges heat with the air when passing through the flat tubes (31, 61).

Advantages of the Invention

In the heat exchanger (23) of the first aspect, the auxiliary windward bank portion (54), the auxiliary leeward bank portion (94), the header collecting pipe (70), the principal leeward bank portion (91), and the principal windward bank portion (51) are arranged in series in the refrigerant flow path. In the heat exchanger (23) functioning as an evaporator, the refrigerant flows from the auxiliary windward bank portion (54) to the principal windward bank portion (51) in this order. Thus, in the entirety of the heat exchanger (23), the refrigerant has a lower temperature than the air. This allows for ensuring the amount of heat absorbed by the refrigerant sufficiently. Also, in the heat exchanger (23) functioning as a condenser, the refrigerant flows from the principal windward bank portion (51) to the auxiliary windward bank portion (54) in this order. Thus, in the entirety of the heat exchanger (23), the refrigerant has a higher temperature than the air. This allows for ensuring the amount of heat dissipated by the refrigerant sufficiently. Accordingly, according to this aspect, in the heat exchanger (23) including the windward tube bank (50) and the leeward tube bank (90), both of the performance as an evaporator and the performance as a condenser are achievable.

In the fifth aspect, in each of the mutually different pairs of the principal windward bank blocks (52*a*-52*f*) and the principal leeward bank blocks (92*a*-920, the flat tubes (31) constituting the principal windward bank block (52*a*-52*f*) and the flat tubes (61) constituting the principal leeward bank blocks (92*a*-92*f*) are individually connected one by one. Thus, the number of distribution of the refrigerant to the plurality of flat tubes (31, 61) in the heat exchanger (23) is reducible, thereby making the mass flow rate of the refrigerant flowing in each of the flat tubes (31, 61) uniform easily.

In the ninth aspect, in each of the mutually different pairs of the auxiliary windward bank blocks (55*a*-55*c*) and the auxiliary leeward bank blocks (95*a*-95*c*), the flat tubes (31) constituting the auxiliary windward bank block (55*a*-55*c*) and the flat tubes (61) constituting the auxiliary leeward bank block (95*a*-95*c*) are individually connected one by one. Thus, the number of distribution of the refrigerant to the plurality of flat tubes (31, 61) in the heat exchanger (23) is reducible, thereby making the mass flow rate of the refrigerant flowing in each of the flat tubes (31, 61) uniform easily.

In the twelfth aspect, each of the principal leeward bank block groups (93*a*-93*c*) paired with the associated one of the auxiliary leeward bank blocks (95*a*-95*c*) is constituted of the plurality of principal leeward bank blocks (92*a*-92*f*). Thus, the number of the flat tubes (61) constituting each of the principal leeward bank blocks (92*a*-92*f*) is reduced in comparison with the case in which one of the auxiliary leeward bank blocks (95*a*-95*c*) is paired with one of the principal leeward bank blocks (92*a*-92*f*), and consequently, the height of the principal communicating spaces (75*a*-75*f*) paired with the principal leeward bank blocks (92*a*-92*f*) is reduced.

On the other hand, the lower the height of the principal communicating spaces (75*a*-75*f*) is, the smaller the difference between the mass flow rate of the refrigerant flowing into the flat tubes (61) near the upper ends of the principal communicating spaces (75*a*-75*f*) and the mass flow rate of the refrigerant flowing into the flat tubes (61) near the lower ends thereof is. Thus, according to the twelfth aspect, when the heat exchanger (23) functions as an evaporator, the difference in the mass flow rate of the refrigerant flowing into each of the flat tubes (61) constituting the principal leeward bank blocks (92*a*-92*f*) is reducible.

BRIEF DESCRIPTION OF THE DRAWINGS

FIGS. 8A and 8B are cross-sectional views of a main part of the outdoor heat exchanger of the first embodiment, wherein FIG. 8A illustrates a cross section taken along the plane D-D of FIG. 8B, and FIG. 8B illustrates a cross section taken along the plane C-C of FIG. 8A.

FIGS. 18A and 18B show changes in temperatures of a refrigerant and air in a conventional heat exchanger functioning as an evaporator, wherein FIG. 18A is a general view of a top of the conventional heat exchanger, and FIG. 18B is a graph showing the changes in temperatures of a refrigerant and air.

FIGS. 20A and 20B show changes in temperatures of a refrigerant and air in a conventional heat exchanger functioning as an evaporator, wherein FIG. 20A is a general view of a top of the conventional heat exchanger, and FIG. 20B is a graph showing the changes in temperatures of a refrigerant and air.

DESCRIPTION OF EMBODIMENTS

Embodiments of the present invention will be described in detail with reference to the drawings. The embodiments and variations described below are merely preferred examples in nature, and are not intended to limit the scope, application, and use of the present invention.

First Embodiment

A first embodiment will be described. A heat exchanger of this embodiment is an outdoor heat exchanger (23) provided in an air conditioner (10). In the following description, the air conditioner (10) will be described first, and then the outdoor heat exchanger (23) will be described in detail.

—Air Conditioner—

Figure 1:
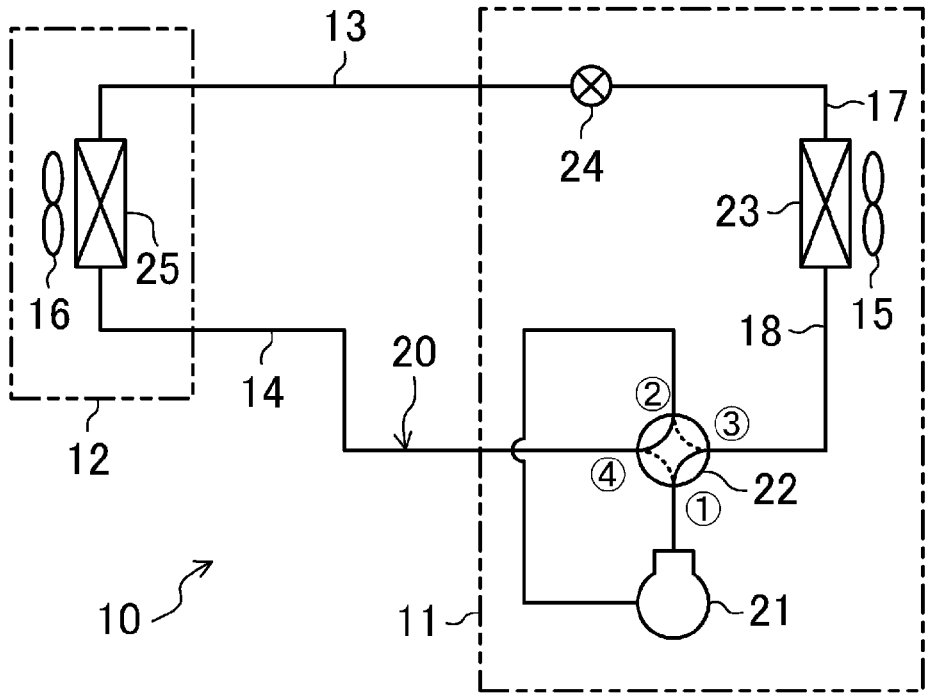
FIG. 1 is a refrigerant circuit diagram showing a general configuration for an air conditioner including an outdoor heat exchanger of a first embodiment.

The air conditioner (10) will be described with reference to FIG. 1.

<Configuration for Air Conditioner>

The air conditioner (10) includes an outdoor unit (11) and an indoor unit (12). The outdoor unit (11) and the indoor unit (12) are connected to each other through a liquid communication pipe (13) and a gas communication pipe (14). In the air conditioner (10), the outdoor unit (11), the indoor unit (12), the liquid communication pipe (13), and the gas communication pipe (14) form a refrigerant circuit (20).

The refrigerant circuit (20) includes a compressor (21), a four-way switching valve (22), an outdoor heat exchanger (23), an expansion valve (24), and an indoor heat exchanger (25). The compressor (21), the four-way switching valve (22), the outdoor heat exchanger (23), and the expansion valve (24) are housed in the outdoor unit (11). The outdoor unit (11) is provided with an outdoor fan (15) configured to supply outdoor air to the outdoor heat exchanger (23). On the other hand, the indoor heat exchanger (25) is housed in the indoor unit (12). The indoor unit (12) is provided with an indoor fan (16) configured to supply indoor air to the indoor heat exchanger (25).

The refrigerant circuit (20) is a closed circuit filled with a refrigerant. In the refrigerant circuit (20), the compressor (21) includes a discharge pipe connected to a first port of the four-way switching valve (22), and a suction pipe connected to a second port of the four-way switching valve (22). Also, in the refrigerant circuit (20), the outdoor heat exchanger (23), the expansion valve (24), and the indoor heat exchanger (25) are arranged in this order from a third port to a fourth port of the four-way switching valve (22). In this refrigerant circuit (20), the outdoor heat exchanger (23) is connected to the expansion valve (24) through a pipe (17), and connected to the third port of the four-way switching valve (22) through a pipe (18).

The compressor (21) is a hermetic scroll or rotary compressor. The four-way switching valve (22) is switchable between a first state (indicated by the solid curves in FIG. 1) and a second state (indicated by the broken curves in FIG. 1). In the first state, the first port communicates with the third port, and the second port communicates with the fourth port. In the second state, the first port communicates with the fourth port, and the second port communicates with the third port. The expansion valve (24) is a so-called electronic expansion valve.

The outdoor heat exchanger (23) allows outdoor air to exchange heat with the refrigerant. The outdoor heat exchanger (23) will be described later. On the other hand, the indoor heat exchanger (25) allows indoor air to exchange heat with the refrigerant. The indoor heat exchanger (25) is a so-called cross-fin type fin-and-tube heat exchanger including circular heat transfer tube.

<Operation of Air Conditioner>

The air conditioner (10) selectively performs cooling operation and heating operation.

During the cooling operation, the refrigerant circuit (20) performs a refrigeration cycle with the four-way switching valve (22) set to the first state. In this state, the refrigerant circulates through the outdoor heat exchanger (23), the expansion valve (24), and the indoor heat exchanger (25) in this order, the outdoor heat exchanger (23) functions as a condenser, and the indoor heat exchanger (25) functions as an evaporator. In the outdoor heat exchanger (23), a gas refrigerant coming from the compressor (21) dissipates heat to outdoor air to condense. Then, the condensed refrigerant flows out toward the expansion valve (24).

During the heating operation, the refrigerant circuit (20) performs a refrigeration cycle with the four-way switching valve (22) set to the second state. In this state, the refrigerant circulates through the indoor heat exchanger (25), the expansion valve (24), and the outdoor heat exchanger (23) in this order, the indoor heat exchanger (25) functions as a condenser, and the outdoor heat exchanger (23) functions as an evaporator. The refrigerant expanded in passing through the expansion valve (24) and turned into a gas-liquid two-phase state flows into the outdoor heat exchanger (23). The refrigerant flowed into the outdoor heat exchanger (23) absorbs heat from the outdoor air to evaporate. Then, the refrigerant flows out toward the compressor (21).

—Outdoor Heat Exchanger—

The outdoor heat exchanger (23) will be described with reference to FIGS. 2-9. The number of flat tubes (31, 61) described below is merely an example.

Figure 2:
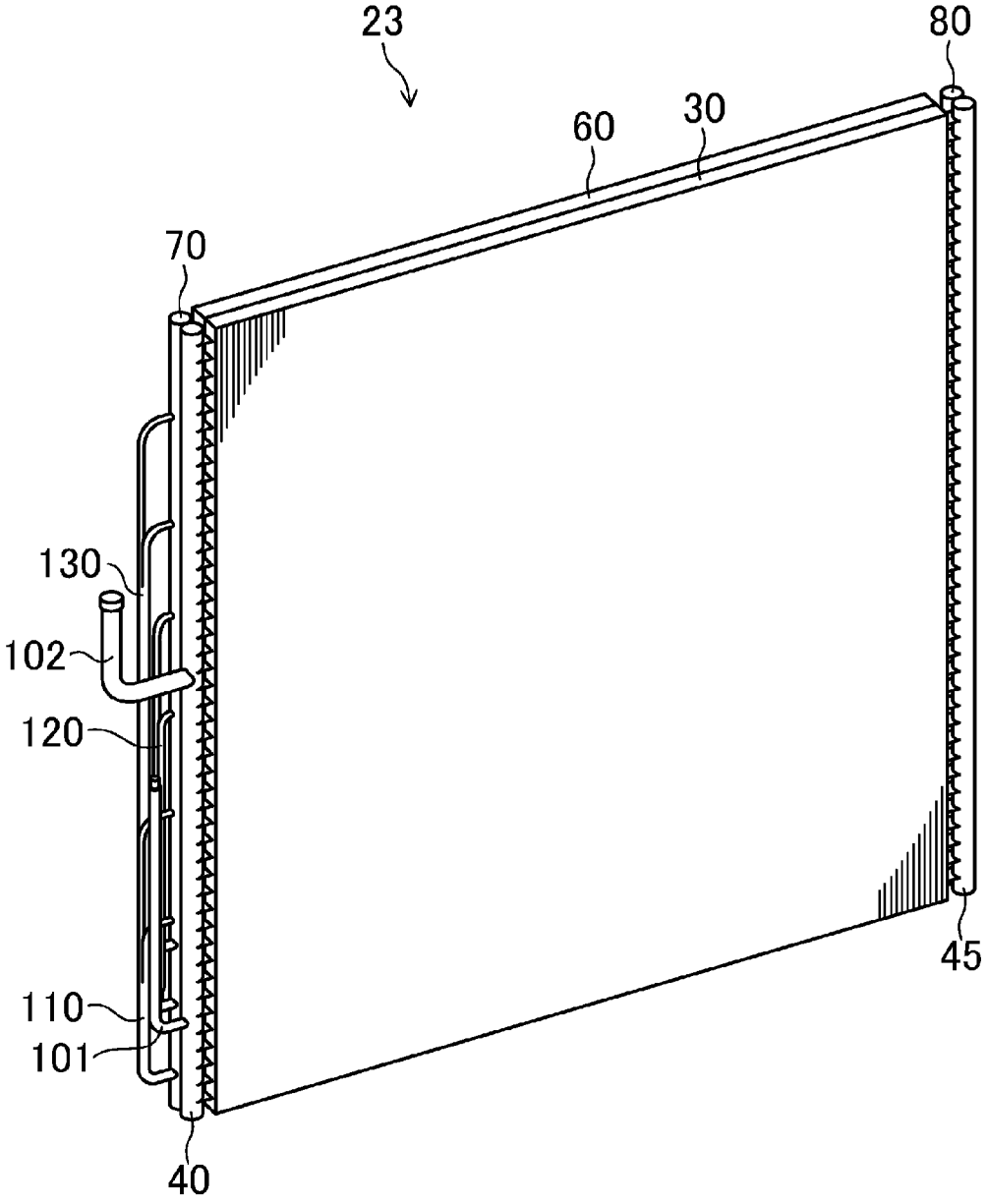
FIG. 2 is a perspective view showing a general configuration for the outdoor heat exchanger of the first embodiment.

As illustrated in FIG. 2, the outdoor heat exchanger (23) is an air heat exchanger having a two column structure, and includes a windward heat exchanger unit (30) and a leeward heat exchanger unit (60). The windward and leeward heat exchanger units (30) and (60) overlap with each other in the flow direction of the air passing through the outdoor heat exchanger (23). In the flow direction of the air passing though the outdoor heat exchanger (23), the windward heat exchanger unit (30) is arranged upstream of the leeward heat exchanger unit (60).

<Configuration for Windward Heat Exchanger Unit>

Figure 3:
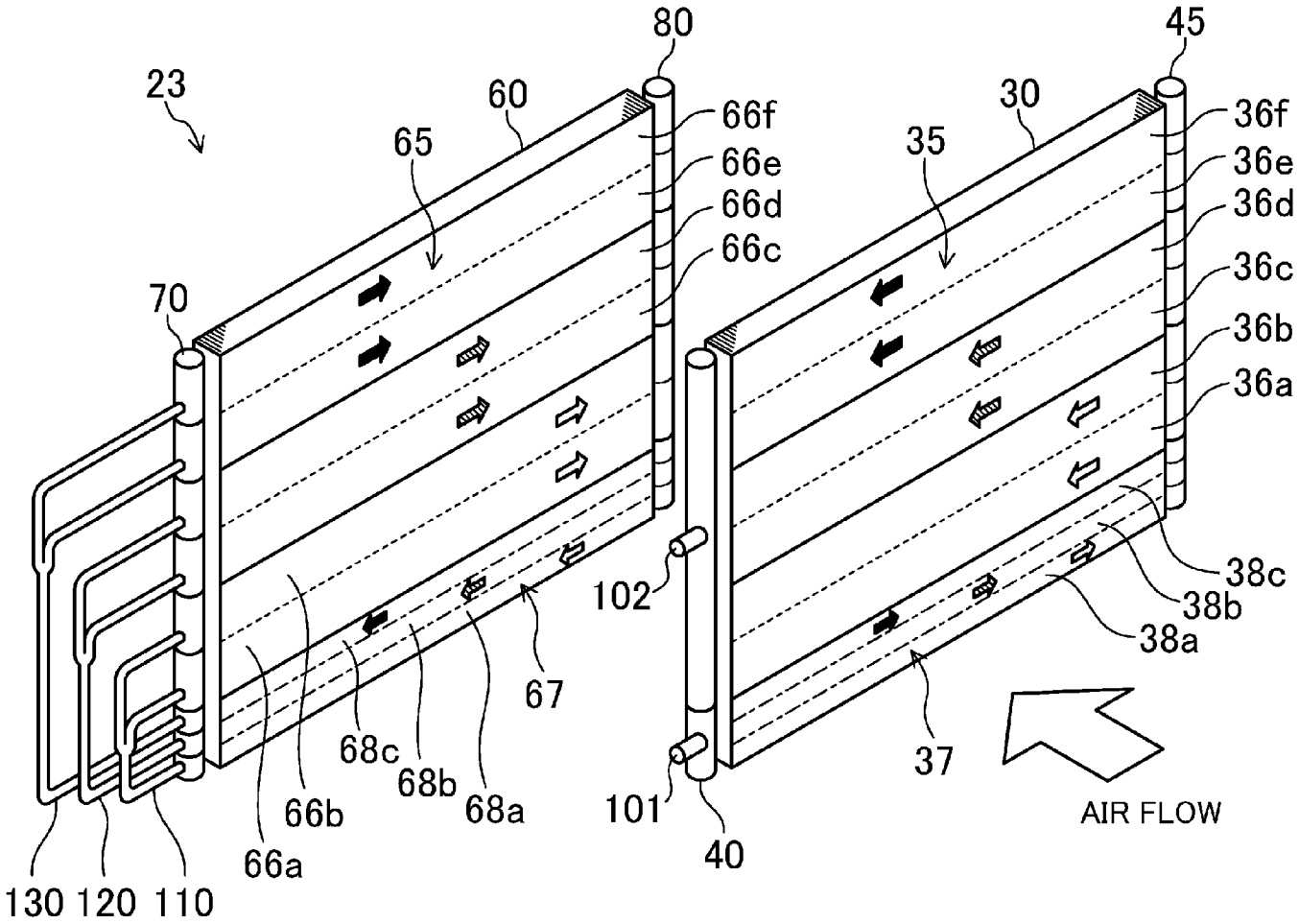
FIG. 3 is a general perspective view showing the outdoor heat exchanger of the first embodiment exploded into a windward heat exchanger unit and a leeward heat exchanger unit, and a refrigerant flow generated when the outdoor heat exchanger functions as an evaporator.
Figure 5:
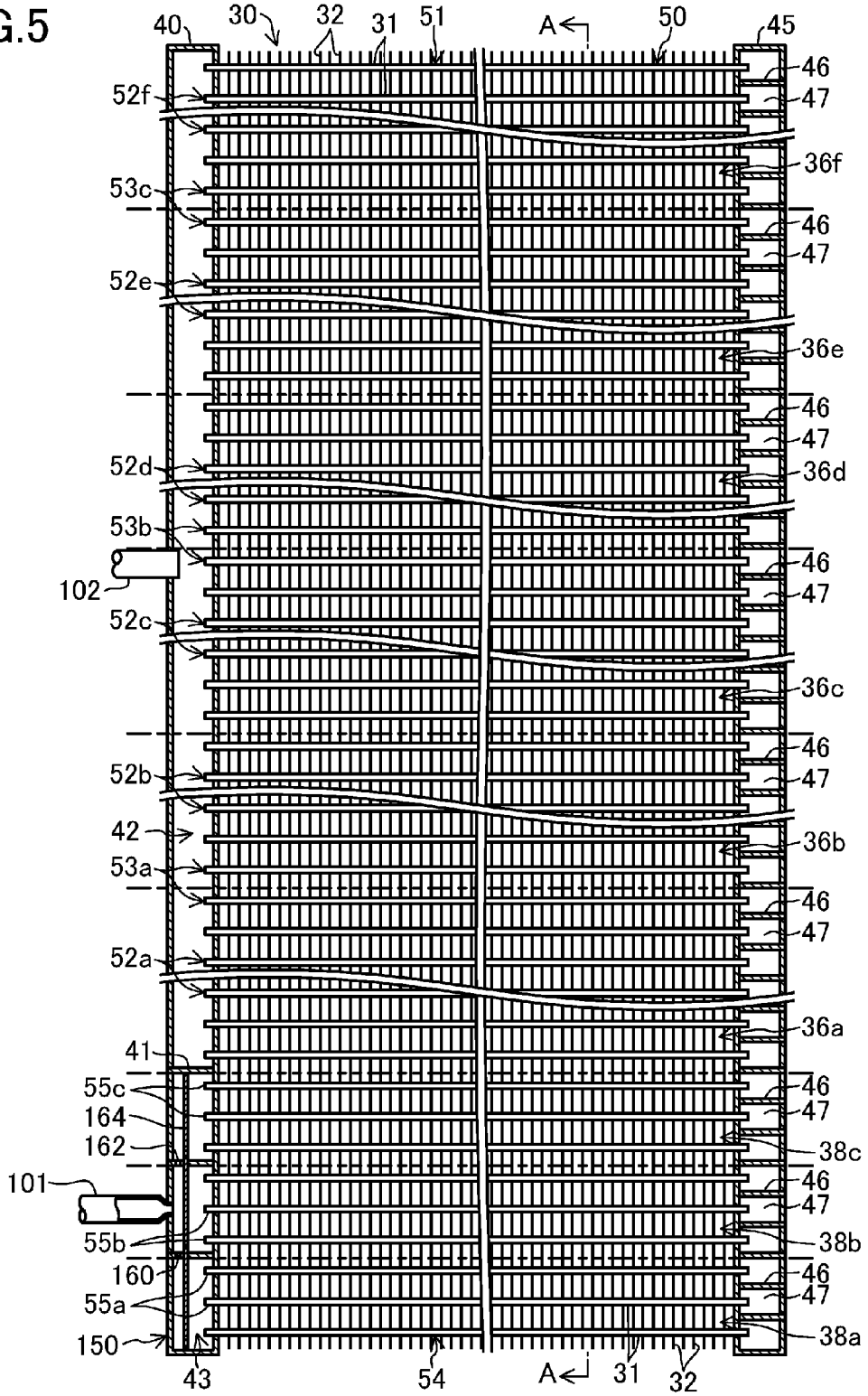
FIG. 5 is a partial cross-sectional view showing the windward heat exchanger unit of the first embodiment as viewed from the front.

As illustrated in FIGS. 3 and 5, the windward heat exchanger unit (30) includes one first windward header collecting pipe (40), one second windward header collecting pipe (45), a plurality of flat tubes (31), and a plurality of fins (32). The first and second windward header collecting pipes (40) and (45), the flat tubes (31), and the fins (32) are each an aluminum alloy member, and are jointed to one another by brazing.

Although the detail will be described later, the windward heat exchanger unit (30) is divided into two regions located one above the other. In the windward heat exchanger unit (30), the upper region serves as a principal windward heat exchange region (35), and the lower region serves as an auxiliary windward heat exchange region (37).

The first and second windward header collecting pipes (40) and (45) each have a long narrow cylindrical shape with both ends thereof closed. In FIG. 5, the first windward header collecting pipe (40) is installed in an upright state at a left end of the windward heat exchanger unit (30), and the second windward header collecting pipe (45) is installed in an upright state at a right end of the windward heat exchanger unit (30). In other words, the first and second windward header collecting pipes (40) and (45) are each installed so that its axial direction extends the vertical direction.

Figure 7:
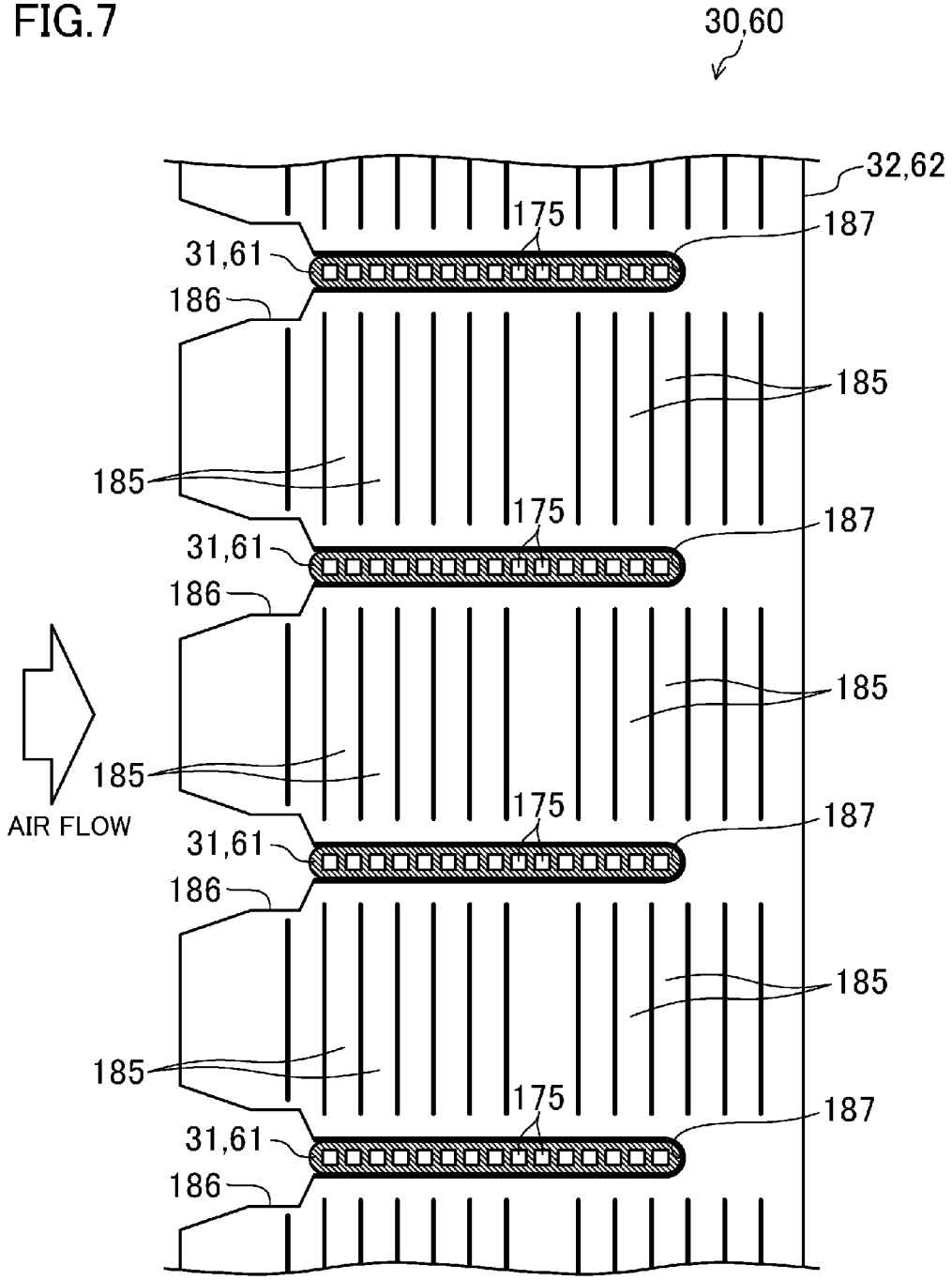
FIG. 7 is an enlarged partial cross-sectional view of the heat exchanger unit taken along the plane A-A of FIG. 5 and the plane B-B of FIG. 6.

As illustrated in FIG. 7, each of the flat tubes (31) is a heat transfer tube having a flat oval cross-section. As illustrated in FIG. 5, in the windward heat exchanger unit (30), the plurality of flat tubes (31) are arranged such that their axes extend along the lateral direction and that a flat surface of each of the flat tubes faces that of the adjacent flat tube. In addition, the plurality of flat tubes (31) are arranged one above the other at regular intervals, and their axial directions are substantially in parallel with one other. Each of the flat tubes (31) has an end inserted in the first windward header collecting pipe (40), and the other end inserted in the second windward header collecting pipe (45). The flat tubes (31) provided in the windward heat exchanger unit (30) constitute a windward tube bank (50).

As illustrated in FIG. 7, a plurality of fluid passages (175) are formed in each of the flat tubes (31). The fluid passages (175) extend in the axial direction of the flat tubes (31), and are aligned in a width direction of the flat tubes (31, 61). Each of the fluid passages (175) opens at both end surfaces of the flat tube (31). The refrigerant supplied to the windward heat exchanger unit (30) exchanges heat with air when flowing through the fluid passages (175) in the flat tubes (31).

As illustrated in FIG. 7, the fin (32) is a vertically elongated plate fin formed by pressing a metal plate. The fin (32) has a plurality of long narrow notches (186) extending in the width direction of the fin (32) from a front edge (i.e., a windward edge portion) of the fin (32). In the fin (32), the plurality of notches (186) are formed at regular intervals in the longitudinal direction (the vertical direction) of the fin (32). A leeward portion of the notch (186) serves as a tube insertion portion (187). The flat tube (31) is inserted to the tube insertion portion (187) of the fin (32), and is jointed to a peripheral edge portion of the tube insertion portion (187) by brazing. Also, the fin (32) is formed with louvers (185) for promoting heat transfer. The plurality of fins (32) are arranged at regular intervals in the axial direction of the flat tube (31).

As illustrated in FIGS. 3 and 5, the windward heat exchanger unit (30) is divided into two heat exchange regions (35, 37) located one above the other. In the windward heat exchanger unit (30), the upper heat exchange region serves as the principal windward heat exchange region (35), and the lower heat exchange region serves as the auxiliary windward heat exchange region (37).

In the windward heat exchanger unit (30), the flat tubes (31) positioned in the principal windward heat exchange region (35) constitute a principal windward bank portion (51), and the flat tubes (31) positioned in the auxiliary windward heat exchange region (37) constitute an auxiliary windward bank portion (54). In other words, some of the flat tubes (31) constituting the windward tube bank (50) constitutes the auxiliary windward bank portion (54), and the rest constitutes the principal windward bank portion (51). Although the detail will be described later, the number of the flat tubes (31) constituting the auxiliary windward bank portion (54) is less than that of the flat tubes (31) constituting the principal windward bank portion (51).

The principal windward heat exchange region (35) is divided into six principal windward heat exchange portions (36*a*-36*f*) located one above the other. On the other hand, the auxiliary windward heat exchange region (37) is divided into three auxiliary windward heat exchange portions (38*a*-38*c*) located one above the other. The numbers of the principal windward heat exchange portions (36*a*-36*f*) and the auxiliary windward heat exchange portions (38*a*-38*c*) shown herein are merely examples.

In the principal windward heat exchange region (35), formed are a first principal windward heat exchange portion (36*a*), a second principal windward heat exchange portion (36*b*), a third principal windward heat exchange portion (36*c*), a fourth principal windward heat exchange portion (36*d*), a fifth principal windward heat exchange portion (36*e*), and a sixth principal windward heat exchange portion (360 in this order from bottom to top. Each of the principal windward heat exchange portions (36*a*-36*f*) is provided with twelve flat tubes (31).

The twelve flat tubes (31) provided in the first principal windward heat exchange portion (36*a*) constitute a first principal windward bank block (52*a*). The twelve flat tubes (31) provided in the second principal windward heat exchange portion (36*b*) constitute a second principal windward bank block (52*b*). The twelve flat tubes (31) provided in the third principal windward heat exchange portion (36*c*) constitute a third principal windward bank block (52*c*). The twelve flat tubes (31) provided in the fourth principal windward heat exchange portion (36*d*) constitute a fourth principal windward bank block (52*d*). The twelve flat tubes (31) provided in the fifth principal windward heat exchange portion (36*e*) constitute a fifth principal windward bank block (52*e*). The twelve flat tubes (31) provided in the sixth principal windward heat exchange portion (36*f*) constitute a sixth principal windward bank block (52*c*). The numbers of the flat tubes (31) constituting the principal windward bank blocks (52*a*-52*f*) need not match with one another.

The first principal windward bank block (52*a*) and the second principal windward bank block (52*b*) constitute a first principal windward bank block group (53*a*). The third principal windward bank block (52*c*) and the fourth principal windward bank block (52*d*) constitute a second principal windward bank block group (53*b*). The fifth principal windward bank block (52*e*) and the sixth principal windward bank block (52*f*) constitute a third principal windward bank block group (53*c*).

In the auxiliary windward heat exchange region (37), formed are a first auxiliary windward heat exchange portion (38*a*), a second auxiliary windward heat exchange portion (38*b*), and a third auxiliary windward heat exchange portion (38*c*) in this order from bottom to top. Each of the auxiliary windward heat exchange portions (38*a*-38*c*) is provided with three flat tubes (31).

The three flat tubes (31) provided in the first auxiliary windward heat exchange portion (38*a*) constitute a first auxiliary windward bank block (55*a*). The three flat tubes (31) provided in the second auxiliary windward heat exchange portion (38*b*) constitute a second auxiliary windward bank block (55*b*). The three flat tubes (31) provided in the third auxiliary windward heat exchange portion (38*c*) constitute a third auxiliary windward bank block (55*c*). The numbers of the flat tubes (31) constituting the auxiliary windward bank blocks (55*a*-55*c*) need not match with one another.

As illustrated in FIG. 5, an inner space of the first windward header collecting pipe (40) is partitioned vertically by a partition plate (41). The first windward header collecting pipe (40) includes an upper space (42) located above the partition plate (41), and a lower space (43) located below the partition plate (41).

The upper space (42) communicates with all the flat tubes (31) constituting the principal windward bank portion (51). A portion of the first windward header collecting pipe (40) forming the upper space (42) is connected to a gas connection pipe (102). This gas connection pipe (102) is connected with the pipe (18) constituting the refrigerant circuit (20).

A portion of the first windward header collecting pipe (40) forming the lower space (43) is connected with a liquid connection pipe (101). This liquid connection pipe (101) is connected with the pipe (17) constituting the refrigerant circuit (20). Although the detail will be described later, a portion of the first windward header collecting pipe (40) forming the lower space (43) constitutes a distributor (150) for distributing a refrigerant to the three auxiliary windward heat exchange portions (38*a*-38*c*).

The second windward header collecting pipe (45) is provided with a plurality of partition plates (46) crossing the inner space of the second windward header collecting pipe (45). The inner space of the second windward header collecting pipe (45) is divided by the partition plates (46) into as many coupling spaces (47) as the flat tubes (31) constituting the windward tube bank (50). Each of the partition plates (46) is arranged between the flat tubes (31) vertically adjacent to each other. Accordingly, each of the coupling spaces (47) communicates with the associated one of the flat tubes (31).

<Configuration for Leeward Heat Exchanger Unit>

Figure 6:
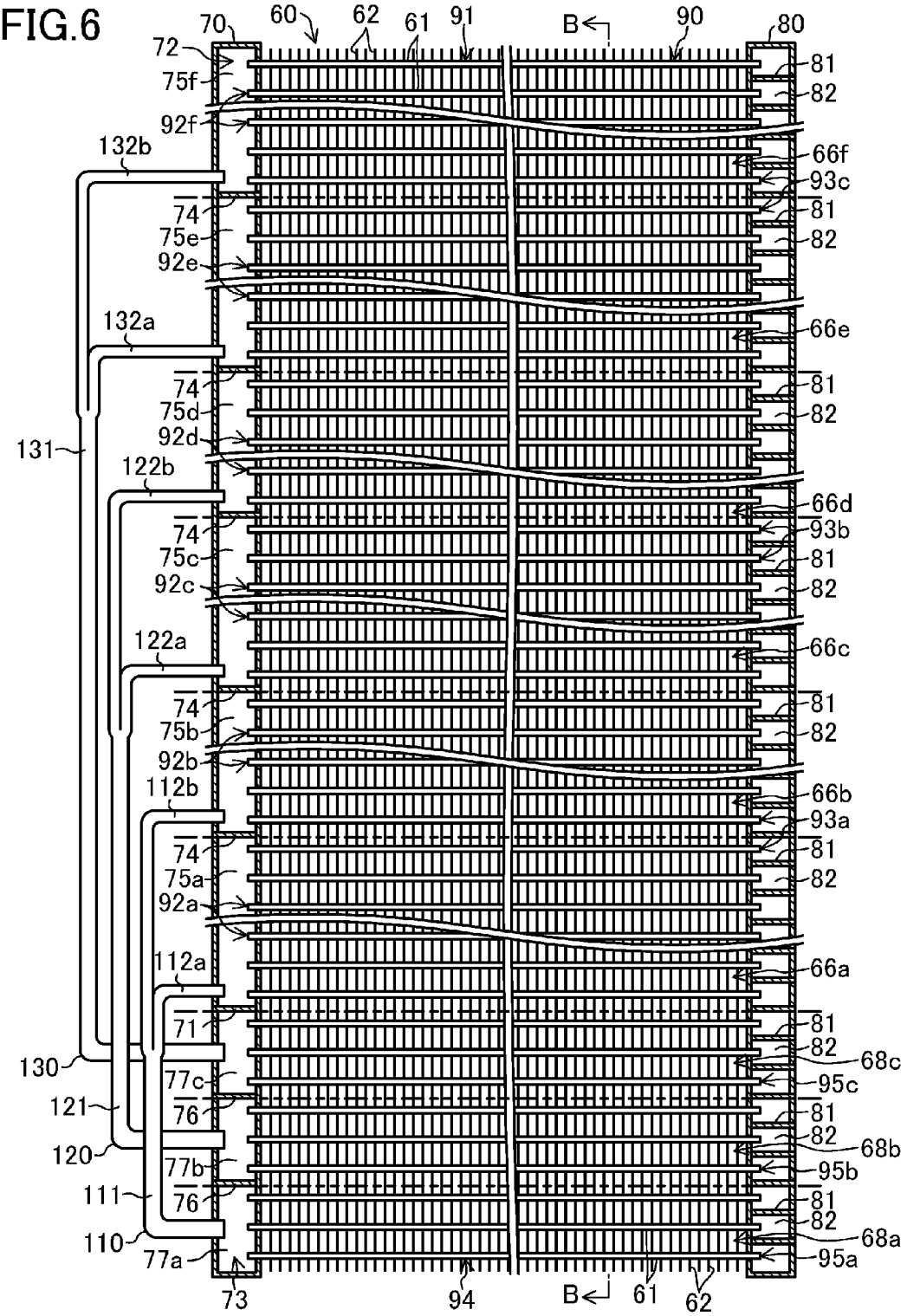
FIG. 6 is a partial cross-sectional view showing the leeward heat exchanger unit of the first embodiment as viewed from the front.

As illustrated in FIGS. 3 and 6, the leeward heat exchanger unit (60) includes one first leeward header collecting pipe (70), one second leeward header collecting pipe (80), a plurality of flat tubes (61), and a plurality of fins (62). The first and second leeward header collecting pipes (70) and (80), the flat tubes (61), and the fins (62) are each an aluminum alloy member, and are jointed to one another by brazing.

Although the detail will be described later, the leeward heat exchanger unit (60) is divided into two heat exchange regions (65, 67) located one above the other. In the leeward heat exchanger unit (60), the upper region serves as a principal leeward heat exchange region (65), and the lower region serves as an auxiliary leeward heat exchange region (67).

The first and second leeward header collecting pipes (70) and (80) each have a long narrow cylindrical shape with both ends thereof closed. In FIG. 6, the first leeward header collecting pipe (70) is installed in an upright state at a left end of the leeward heat exchanger unit (60), and the second leeward header collecting pipe (80) is installed in an upright state at a right end of the leeward heat exchanger unit (60). In other words, the first and second leeward header collecting pipes (70) and (80) are each installed so that its axial direction extends along the vertical direction.

As illustrated in FIG. 7, each of the flat tubes (61) is a heat transfer tube having the same shape as the flat tube (31) in the windward heat exchanger unit (30) does. The refrigerant supplied to the leeward heat exchanger unit (60) exchanges heat with air when flowing through the fluid passage (175) in the flat tube (61).

As illustrated in FIG. 6, in the leeward heat exchanger unit (60), the plurality of flat tubes (61) are arranged similarly to the flat tubes (31) in the windward heat exchanger unit (30). Each of the flat tubes (61) arranged one above the other has an end inserted in the first leeward header collecting pipe (70), and the other end inserted in the second leeward header collecting pipe (80). The flat tubes (61) provided in the leeward heat exchanger unit (60) constitute a leeward tube bank (90). The number of the flat tubes (61) constituting the leeward tube bank (90) is equal to that of the flat tubes (31) constituting the windward tube bank (50).

As illustrated in FIG. 7, the fin (62) is a vertically elongated plate fin formed by pressing a metal plate. This fin (62) has the same shape as the fin (32) of the windward heat exchanger unit (30). In other words, the fin (62) is formed with the notches (186), and each of the flat tubes (61) is jointed to the tube insertion portion (187) which is part of the notch (186). In addition, the fin (62) is formed with louvers (185) for promoting heat transfer. The plurality of fins (62) are arranged at regular intervals in the axial direction of the flat tubes (61).

As illustrated in FIGS. 3 and 6, the leeward heat exchanger unit (60) is divided into two heat exchange regions (65, 67) located one above the other. In the leeward heat exchanger unit (60), the upper heat exchange region serves as the principal leeward heat exchange region (65), and the lower heat exchange region serves as the auxiliary leeward heat exchange region (67).

In the leeward heat exchanger unit (60), the flat tubes (61) positioned in the principal leeward heat exchange region (65) constitute a principal leeward bank portion (91), and the flat tubes (61) positioned in the auxiliary leeward heat exchange region (67) constitute an auxiliary leeward bank portion (94). In other words, some of the flat tubes (61) constituting the leeward tube bank (90) constitutes the auxiliary leeward bank portion (94), and the rest constitutes the principal leeward bank portion (91). Although the detail will be described later, the number of the flat tubes (61) constituting the auxiliary leeward bank portion (94) is less than that of the flat tubes (61) constituting the principal leeward bank portion (91). Also, the number of the flat tubes (61) constituting the principal leeward bank portion (91) is equal to that of the flat tubes (31) constituting the principal windward bank portion (51), and the number of the flat tubes (61) constituting the auxiliary leeward bank portion (94) is equal to that of the flat tubes (31) constituting the auxiliary windward bank portion (54).

The principal leeward heat exchange region (65) is divided into six principal leeward heat exchange portions (66*a*-66*f*) located one above the other. On the other hand, the auxiliary leeward heat exchange region (67) is divided into three auxiliary leeward heat exchange portions (68*a*-68*c*) located one above the other. The numbers of the principal leeward heat exchange portions (66*a*-66*f*) and the auxiliary leeward heat exchange portions (68*a*-68*c*) shown herein are merely examples. However, the numbers of the principal leeward heat exchange portions (66*a*-66*f*) are preferably equal to those of the principal windward heat exchange portions (36*a*-36*f*), and the numbers of the auxiliary leeward heat exchange portions (68*a*-68*c*) are preferably equal to those of the auxiliary windward heat exchange portions (38*a*-38*c*).

In the principal leeward heat exchange region (65), formed are a first principal leeward heat exchange portion (66*a*), a second principal leeward heat exchange portion (66*b*), a third principal leeward heat exchange portion (66*c*), a fourth principal leeward heat exchange portion (66*d*), a fifth principal leeward heat exchange portion (66*e*), and a sixth principal leeward heat exchange portion (66*f*) in this order from bottom to top. Each of the principal leeward heat exchange portions (66*a*-66*f*) is provided with twelve flat tubes (61).

The twelve flat tubes (61) provided in the first principal leeward heat exchange portion (66*a*) constitute a first principal leeward bank block (92*a*). The twelve flat tubes (61) provided in the second principal leeward heat exchange portion (66*b*) constitute a second principal leeward bank block (92*b*). The twelve flat tubes (61) provided in the third principal leeward heat exchange portion (66*c*) constitute a third principal leeward bank block (92*c*). The twelve flat tubes (61) provided in the fourth principal leeward heat exchange portion (66*d*) constitute a fourth principal leeward bank block (92*d*). The twelve flat tubes (61) provided in the fifth principal leeward heat exchange portion (66*e*) constitute a fifth principal leeward bank block (92*e*). The twelve flat tubes (61) provided in the sixth principal leeward heat exchange portion (66*f*) constitute a sixth principal leeward bank block (92*f*).

The numbers of the flat tubes (61) constituting the principal leeward bank blocks (92*a*-92*f*) need not match with one another. However, even if the numbers of the flat tubes (61) constituting the principal leeward bank blocks (92*a*-92*f*) do not match with one another, the number of the flat tubes (61) constituting the first principal leeward bank block (92*a*) is preferably equal to that of the flat tubes (31) constituting the first principal windward bank block (52*a*), the number of the flat tubes (61) constituting the second principal leeward bank block (92*b*) is preferably equal to that of the flat tubes (31) constituting the second principal windward bank block (52*b*), the number of the flat tubes (61) constituting the third principal leeward bank block (92*c*) is preferably equal to that of the flat tubes (31) constituting the third principal windward bank block (52*c*), the number of the flat tubes (61) constituting the fourth principal leeward bank block (92*d*) is preferably equal to that of the flat tubes (31) constituting the fourth principal windward bank block (52*d*), the number of the flat tubes (61) constituting the fifth principal leeward bank block (92*e*) is preferably equal to that of the flat tubes (31) constituting the fifth principal windward bank block (52*e*), and the number of flat tubes (61) constituting the sixth principal leeward bank block (92*f*) is preferably equal to that of the flat tubes (31) constituting the sixth principal windward bank block (52*f*).

The first and second principal leeward bank blocks (92*a*) and (92*b*) constitute a first principal leeward bank block group (93*a*). The third and fourth principal leeward bank blocks (92*c*) and (92*d*) constitute a second principal leeward bank block group (93*b*). The fifth and sixth principal leeward bank blocks (92*e*) and (92*f*) constitute a third principal leeward bank block group (93*c*).

In the auxiliary leeward heat exchange region (67), formed are a first auxiliary leeward heat exchange portion (68*a*), a second auxiliary leeward heat exchange portion (68*b*), and a third auxiliary leeward heat exchange portion (68*c*) in this order from bottom to top. Each of the auxiliary leeward heat exchange portions (68*a*-68*c*) is provided with three flat tubes (61).

The three flat tubes (61) provided in the first auxiliary leeward heat exchange portion (68*a*) constitute a first auxiliary leeward bank block (95*a*). The three flat tubes (61) provided in the second auxiliary leeward heat exchange portion (68*b*) constitute a second auxiliary leeward bank block (95*b*). The three flat tubes (61) provided in the third auxiliary leeward heat exchange portion (68*c*) constitute a third auxiliary leeward bank block (95*c*).

The numbers of the flat tubes (61) constituting the auxiliary leeward bank blocks (95*a*-95*c*) need not match with one another. However, even if the numbers of the flat tubes (61) constituting the auxiliary leeward bank blocks (95*a*-95*c*) do not match with one another, the number of the flat tubes (61) constituting the first auxiliary leeward bank block (95*a*) is preferably equal to that of the flat tubes (31) constituting the first auxiliary windward bank block (55*a*), the number of the flat tubes (61) constituting the second auxiliary leeward bank block (95*b*) is preferably equal to that of the flat tubes (31) constituting the second auxiliary windward bank block (55*b*), and the number of flat tubes (61) constituting the third auxiliary leeward bank block (95*c*) is preferably equal to that of the flat tubes (31) constituting the third auxiliary windward bank block (55*c*).

As illustrated in FIG. 6, an inner space of the first leeward header collecting pipe (70) is partitioned vertically by a partition plate (71). The first leeward header collecting pipe (70) includes an upper space (72) located above the partition plate (71), and a lower space (73) located below the partition plate (71).

The upper space (72) is partitioned by five partition plates (74) into six principal communicating spaces (75*a*-75*f*). In other words, in a space above the partition plate (71) in the first leeward header collecting pipe (70), formed are a first principal communicating space (75*a*), a second principal communicating space (75*b*), a third principal communicating space (75*c*), a fourth principal communicating space (75*d*), a fifth principal communicating space (75*e*), a sixth principal communicating space (75*f*) in this order from bottom to top.

The first principal communicating space (75*a*) communicates with the twelve flat tubes (61) constituting the first principal leeward bank block (92*a*). The second principal communicating space (75*b*) communicates with the twelve flat tubes (61) constituting the second principal leeward bank block (92*b*). The third principal communicating space (75*c*) communicates with the twelve flat tubes (61) constituting the third principal leeward bank block (92*c*). The fourth principal communicating space (75*d*) communicates with the twelve flat tubes (61) constituting the fourth principal leeward bank block (92*d*). The fifth principal communicating space (75*e*) communicates with the twelve flat tubes (61) constituting the fifth principal leeward bank block (92*e*). The sixth principal communicating space (75*f*) communicates with the twelve flat tubes (61) constituting the sixth principal leeward bank block (92*f*).

The lower space (73) is divided into three auxiliary communicating spaces (77*a*-77*c*) by two partition plates (76). In other words, in a space below the partition plate (71) in the first leeward header collecting pipe (70), a first auxiliary communicating space (77*a*), a second auxiliary communicating space (77*b*), and a third auxiliary communicating space (77*c*) are formed in this order from bottom to top.

The first auxiliary communicating space (77*a*) communicates with the three flat tubes (61) constituting the first auxiliary leeward bank block (95*a*). The second auxiliary communicating space (77*b*) communicates with the three flat tubes (61) constituting the second auxiliary leeward bank block (95*b*). The third auxiliary communicating space (77*c*) communicates with the three flat tubes (61) constituting the third auxiliary leeward bank block (95*c*).

Three connection pipes (110, 120, 130) are attached to the first leeward header collecting pipe (70). Each of the connection pipes (110, 120, 130) includes one principal pipe portion (111, 121, 131) and two branch pipe portions (112*a*, 112*b*, 122*a*, 122*b*, 132*a*, 132*b*) connected to an end of the principal pipe portion (111, 121, 131).

The first connection pipe (110) connects the first auxiliary leeward bank block (95*a*) with the first principal leeward bank block group (93*a*). Specifically, in the first connection pipe (110), the principal pipe portion (111) has an opening end communicating with the first auxiliary communicating space (77*a*). The branch pipe portion (112*a*), which is one of the branch pipe portions, has an opening end communicating with the first principal communicating space (75*a*), and the branch pipe portion (112*b*), which is the other one of the branch pipe portions, has an opening end communicating with the second principal communicating space (75*b*). That is, the first auxiliary communicating space (77*a*) is connected to both the first principal communicating space (75*a*) associated with the first principal leeward bank block (92*a*) and the second principal communicating space (75*b*) associated with the second principal leeward bank block (92*b*).

The second connection pipe (120) connects the second auxiliary leeward bank block (95*b*) to the second principal leeward bank block group (93*b*). Specifically, in the second connection pipe (120), the principal pipe portion (121) has an opening end communicating with the second auxiliary communicating space (77*b*). The branch pipe portion (122*a*), which is one of the branch pipe portions, has an opening end communicating with the third principal communicating space (75*c*), and the branch pipe portion (122*b*), which is the other one of the branch pipe portions, has an opening end communicating with the fourth principal communicating space (75*d*). That is, the second auxiliary communicating space (77*b*) is connected to both the third principal communicating space (75*c*) associated with the third principal leeward bank block (92*c*) and the fourth principal communicating space (75*d*) associated with the fourth principal leeward bank block (92*d*).

The third connection pipe (130) connects the third auxiliary leeward bank block (95*c*) to the third principal leeward bank block group (93*c*). Specifically, in the third connection pipe (130), the principal pipe portion (131) has an opening end communicating with the third auxiliary communicating space (77*c*). The branch pipe portion (132*a*), which is one of the branch pipe portions, has an opening end communicating with the fifth principal communicating space (75*e*), and the branch pipe portion (132*b*), which is the other one of the branch pipe portions, has an opening end communicating with the sixth principal communicating space (75*f*). That is, the third auxiliary communicating space (77*c*) is connected to both the fifth principal communicating space (75*e*) associated with the fifth principal leeward bank block (92*e*) and the sixth principal communicating space (75*f*) associated with the sixth principal leeward bank block (92*f*).

The second leeward header collecting pipe (80) is provided with a plurality of partition plates (81) crossing a space inside the second leeward header collecting pipe (80). The space inside the second leeward header collecting pipe (80) is divided by the partition plates (81) into as many coupling spaces (82) as the flat tubes (61) constituting the leeward tube bank (90). Each of the partition plates (81) is arranged between the flat tubes (61) vertically adjacent to each other. Accordingly, each of the coupling spaces (82) communicates with the associated one of the flat tubes (61).

Figure 8A:
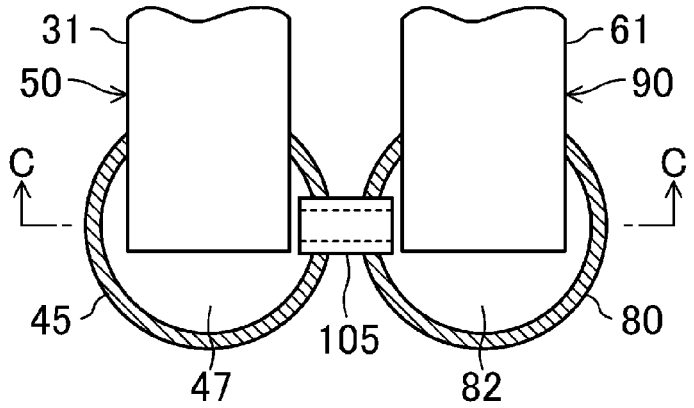
Figure 8B:
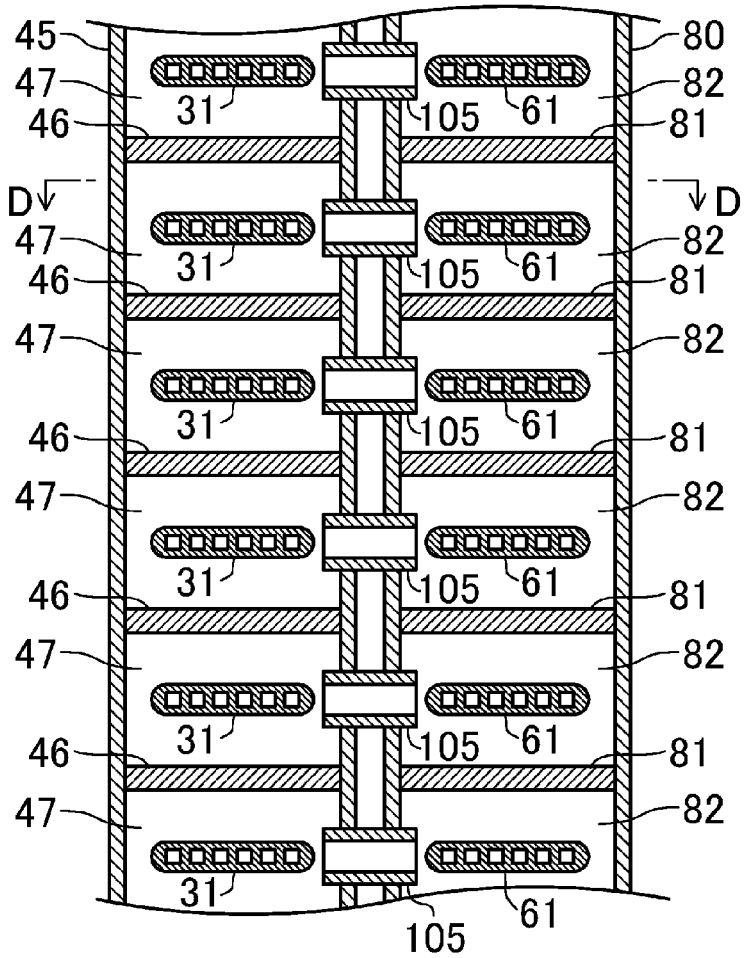
Figure 9:
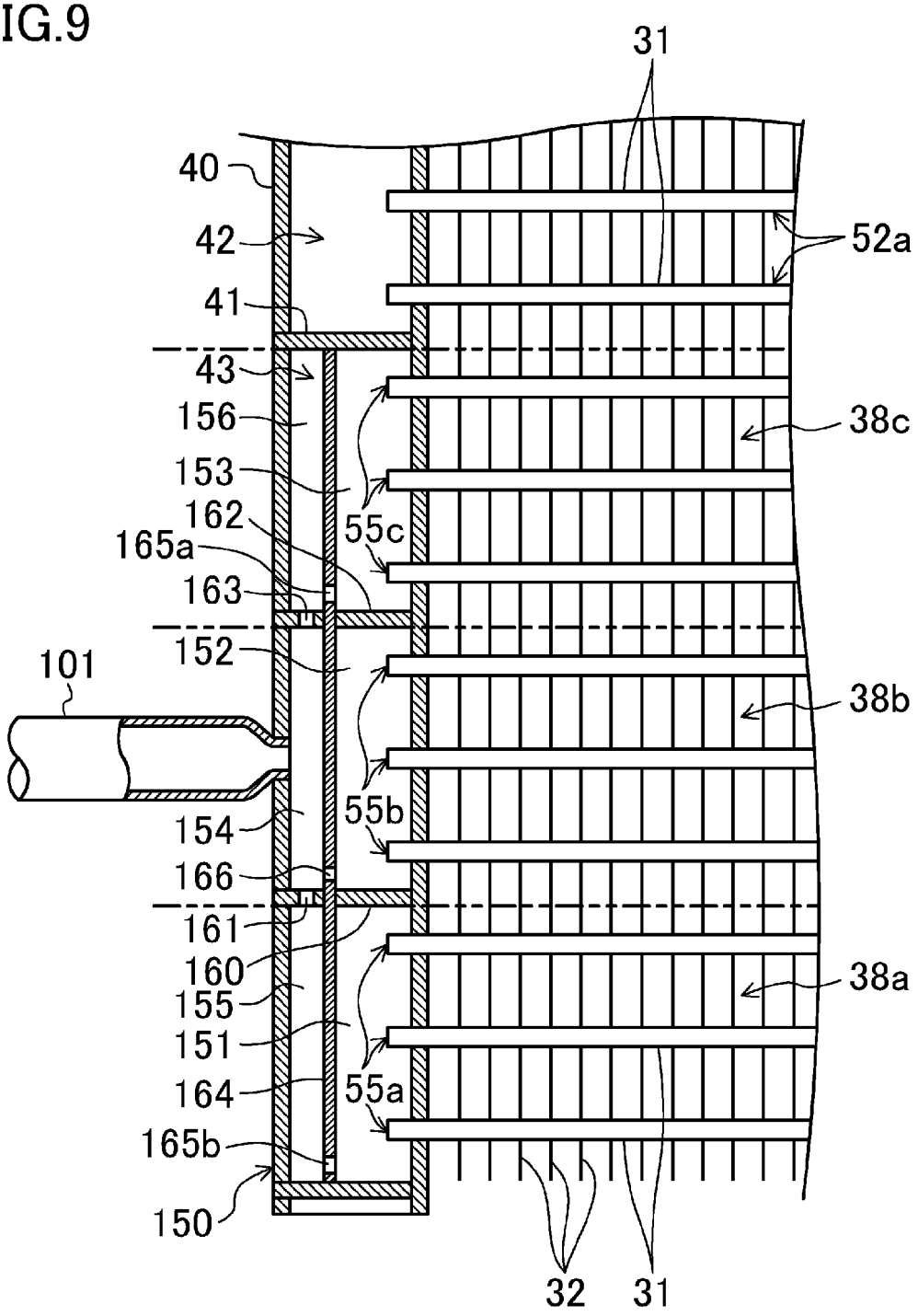
FIG. 9 is an enlarged partial cross-sectional view of the windward heat exchanger unit of the first embodiment as viewed from the front.

As illustrated in FIG. 8, the second leeward header collecting pipe (80) is connected to the second windward header collecting pipe (45) through as many coupling pipes (105) as the flat tubes (31) constituting the windward tube bank (50) and the flat tubes (61) constituting the leeward tube bank (90). The coupling pipes (105) are relatively short circular pipes. Each of the coupling pipes (105) allows the coupling space (47) in the second windward header collecting pipe (45) to individually communicate with each of the coupling spaces (82) in the second leeward header collecting pipe (80).

<Configuration for Distributor>

As can be seen from the foregoing, the portion of the first windward header collecting pipe (40) forming the lower space (43) constitutes the distributor (150). When the outdoor heat exchanger (23) functions as an evaporator, this distributor (150) distributes the refrigerant in a gas-liquid two-phase state supplied to the outdoor heat exchanger (23) to the three auxiliary windward heat exchange portions (38*a*-38*c*). Here, the distributor (150) will be described with reference to FIG. 9.

In the lower space (43), two horizontal partition plates (160, 162) and one vertical partition plate (164) are provided. The lower space (43) is divided into three communicating chambers (151-153), one mixing chamber (154), and two intermediate chambers (155, 156) by the two horizontal partition plates (160, 162) and the one vertical partition plate (164).

Specifically, each of the horizontal partition plates (160, 162) is arranged so as to cross the lower space (43), and divides the lower side space (43) vertically. The lower one of the horizontal partition plates (160) is arranged between the first auxiliary windward bank block (55*a*) and the second auxiliary windward bank block (55*b*), and the upper one of the horizontal partition plates (162) is arranged between the second auxiliary windward bank block (55*b*) and the third auxiliary windward bank block (55*c*). The vertical partition plate (164) is a long narrow rectangular plate member. The vertical partition plate (164) is arranged along the axial direction of the first windward header collecting pipe (40), and divides the lower space (43) into a space closer to the flat tube (31) and a space closer to the liquid connection pipe (101).

A portion of the lower space (43) below the lower horizontal partition plate (160) is divided into a first communicating chamber (151) closer to the flat tube (31) and a lower intermediate chamber (155) closer to the liquid connection pipe (101) by the vertical partition plate (164). The first communicating chamber (151) communicates with the three flat tubes (31) constituting the first auxiliary windward bank block (55*a*).

A portion of the lower space (43) between the lower and upper horizontal partition plates (160) and (162) is divided into a second communicating chamber (152) closer to the flat tube (31) and the mixing chamber (154) closer to the liquid connection pipe (101) by the vertical partition plate (164). The second communicating chamber (152) communicates with the three flat tubes (61) constituting the second auxiliary windward bank block (55*b*). The mixing chamber (154) communicates with the liquid connection pipe (101).

A portion of the lower space (43) above the upper horizontal partition plate (162) is divided into a third communicating chamber (153) closer to the flat tube (31) and an upper intermediate chamber (156) closer to the liquid connection pipe (101) by the vertical partition plate (164). The third communicating chamber (153) communicates with the three flat tubes (31) constituting the third auxiliary windward bank block (55*c*).

Communicating holes (165*a*, 165*b*) are formed through an upper portion and a lower portion of the vertical partition plate (164), respectively. Each of the communicating holes (165*a*, 165*b*) is a horizontally oriented rectangular through hole. The communicating hole (165*b*) in the lower portion of the vertical partition plate (164) is formed near a lower end of the vertical partition plate (164) located below the lower horizontal partition plate (160) and allows the first communicating chamber (151) to communicate with the lower intermediate chamber (155). The communicating hole (165*a*) in the upper portion of the vertical partition plate (164) is formed near a lower end of the vertical partition plate (164) located above the upper horizontal partition plate (162) and allows the third communicating chamber (153) to communicate with the upper intermediate chamber (156).

A flow rate adjusting hole (161) formed through a portion of the lower horizontal partition plate (160) facing the mixing chamber (154). The first communicating chamber (151) communicates with the mixing chamber (154) through the flow rate adjusting hole (161). A flow rate adjusting hole (163) is formed through a portion of the upper horizontal partition plate (162) facing the mixing chamber (154). The third communicating chamber (153) communicates with the mixing chamber (154) through the flow rate adjusting hole (163). A flow rate adjusting hole (166) is formed near a lower end of a portion of the vertical partition plate (164) facing the mixing chamber (154). The second communicating chamber (152) communicates with the mixing chamber (154) through the flow rate adjusting hole (166).

In the distributor (150), the flow rate adjusting hole (161) of the lower horizontal partition plate (160), the flow rate adjusting hole (163) of the upper horizontal partition plate (162), and the flow rate adjusting hole (166) of the vertical partition plate (164) are circular through holes which have relatively small diameters. In the distributor (150), the flow rate adjusting holes (161, 163, 166) have their opening areas (i.e., their diameters) set so that the refrigerant is distributed at predetermined rates to each of the auxiliary windward bank blocks (55*a*-55*c*).

<Refrigerant Flow in Outdoor Heat Exchanger Functioning as Evaporator>

During a heating operation of the air conditioner (10), the outdoor heat exchanger (23) functions as an evaporator. A refrigerant flow in the outdoor heat exchanger (23) performing the heating operation will be described below. The temperatures of refrigerants and air shown in the following description are merely examples.

The refrigerant expanded in passing through the expansion valve (24) and turned a gas-liquid two-phase refrigerant is supplied to the outdoor heat exchanger (23) through the pipe (17). As illustrated in FIG. 3, the refrigerant supplied from the pipe (17) to the liquid connection pipe (101) passes through the flat tubes (31) constituting the auxiliary windward bank portion (54), the flat tubes (61) constituting the auxiliary leeward bank portion (94), the flat tubes (61) constituting the principal leeward bank portion (91), and the flat tubes (31) constituting the principal windward bank portion (51) in this order, and then flows into the pipe (18) through the gas connection pipe (102).

The refrigerant flow in the outdoor heat exchanger (23) will be described in detail below.

As illustrated in FIG. 5, the gas-liquid two-phase refrigerant flowed from the liquid connection pipe (101) to the mixing chamber (154) is distributed to the three communicating chambers (151-153) so that the refrigerant flows into the flat tubes (31) constituting each of the auxiliary windward bank blocks (55*a*-55*c*) associated with each of the communicating chambers (151-153). The refrigerant flowing through the flat tubes (31) constituting the auxiliary windward bank blocks (55*a*-55*c*) exchanges heat with the outdoor air supplied to the outdoor heat exchanger (23). The refrigerant passed through the flat tubes (31) constituting each of the auxiliary windward bank blocks (55*a*-55*c*) passes through the coupling space (47) and the coupling pipe (105) in the second windward header collecting pipe (45) in this order, and flows into the coupling space (82) in the second leeward header collecting pipe (80).

As illustrated in FIG. 6, the refrigerant flowed into the coupling space (82) in the second leeward header collecting pipe (80) flows into the flat tubes (61) constituting each of the auxiliary leeward bank blocks (95*a*-95*c*).

As can be seen from the foregoing, the flat tubes (31) of each of the auxiliary windward bank blocks (55*a*-55*c*) and the flat tubes (61) of each of the auxiliary leeward bank blocks (95*a*-95*c*) are individually connected one by one through the coupling pipes (105) (see FIG. 8). Accordingly, the refrigerant that has passed through the flat tubes (31) of the first auxiliary windward bank block (55*a*) flows into the flat tubes (61) of the first auxiliary leeward bank block (95*a*). In addition, the refrigerant that has passed through the flat tubes (31) of the second auxiliary windward bank block (55*b*) flows into the flat tubes (61) of the second auxiliary leeward bank block (95*b*). In addition, the refrigerant that has passed through the flat tubes (31) of the third auxiliary windward bank block (55*c*) flows into the flat tubes (61) of the third auxiliary leeward bank block (95*c*).

The refrigerant flowing through the flat tubes (61) of each of the auxiliary leeward bank blocks (95*a*-95*c*) exchanges heat with the outdoor air that has passed through the auxiliary windward heat exchange region (37). The flows of the refrigerant that have passed through the three flat tubes (61) of each of the auxiliary leeward bank blocks (95*a*-95*c*) enter, and merge together in, an associated one of the auxiliary communicating spaces (77*a*-77*c*) of the first leeward header collecting pipe (70) associated with the auxiliary leeward bank blocks (95*a*-95*c*).

Part of the refrigerant flowed from the first auxiliary communicating space (77*a*) into the principal pipe portion (111) of the first connection pipe (110) flows into the first principal communicating space (75*a*) through the branch pipe portion (112*a*), which is one of the branch pipe portions, and the rest of the refrigerant flows into the second principal communicating space (75*b*) passes through the branch pipe portion (112*b*), which is the other one of the branch pipe portions. Part of the refrigerant flowed from the second auxiliary communicating space (77*b*) into the principal pipe portion (121) of the second connection pipe (120) flows into the third principal communicating space (75*c*) through the branch pipe portion (122*a*), which is one of the branch pipe portions, and the rest of the refrigerant flows into the fourth principal communicating space (75*d*) through the branch pipe portion (122*b*), which is the other one of the branch pipe portions. Part of the refrigerant flowed from the third auxiliary communicating space (77*c*) into the principal pipe portion (131) of the third connection pipe (130) flows into the fifth principal communicating space (75*e*) through the branch pipe portion (132*a*), which is one of the branch pipe portions, and the rest of the refrigerant flows into the sixth principal communicating space (75*f*) through the branch pipe portion (132*b*), which is the other one of the branch pipe portions.

The refrigerant that has flowed into each of the principal communicating spaces (75*a*-75*f*) in the first leeward header collecting pipe (70) separately flows into the twelve flat tubes (61) constituting one of the principal leeward bank blocks (92*a*-92*f*) associated with the principal communicating spaces (75*a*-75*f*). The refrigerant in the first principal communicating space (75*a*) flows into the flat tubes (61) constituting the first principal leeward bank block (92*a*). The refrigerant in the second principal communicating space (75*b*) flows into the flat tubes (61) constituting the second principal leeward bank block (92*b*). The refrigerant in the third principal communicating space (75*c*) flows into the flat tubes (61) constituting the third principal leeward bank block (92*c*). The refrigerant in the fourth principal communicating space (75*d*) flows into the flat tubes (61) constituting the fourth principal leeward bank block (92*d*). The refrigerant in the fifth principal communicating space (75*e*) flows into the flat tubes (61) constituting the fifth principal leeward bank block (92*e*). The refrigerant in the sixth principal communicating space (75*f*) flows into the flat tubes (61) constituting the sixth principal leeward bank block (92*f*).

The refrigerant flowing through the flat tubes (61) of each of the principal leeward bank blocks (92*a*-92*f*) exchanges heat with the outdoor air that has passed through the principal windward heat exchange region (35). The refrigerant that has passed through the flat tubes (61) of each of the principal leeward bank blocks (92*a*-92*f*) passes through the coupling space (82) and the coupling pipe (105) in the second leeward header collecting pipe (80) in this order, and flows into the coupling space (47) in the second windward header collecting pipe (45).

As illustrated in FIG. 5, the refrigerant flowed into the coupling space (47) in the second windward header collecting pipe (45) flows into the flat tubes (31) constituting the principal windward bank blocks (52*a*-52*f*).

As can be seen from the foregoing, the flat tubes (31) of each of the principal windward bank blocks (52*a*-52*f*) and the flat tubes (61) of each of the principal leeward bank blocks (92*a*-92*f*) are individually connected one by one through the coupling pipes (105) (see FIG. 8). Accordingly, the refrigerant that has passed through the flat tubes (61) of the first principal leeward bank block (92*a*) flows into the flat tubes (31) of the first principal windward bank block (52*a*). In addition, the refrigerant that has passed through the flat tubes (61) of the second principal leeward bank block (92*b*) flows into the flat tubes (31) of the second principal windward bank block (52*b*). In addition, the refrigerant that has passed through the flat tubes (61) of the third principal leeward bank block (92*c*) flows into the flat tubes (31) of the third principal windward bank block (52*c*). In addition, the refrigerant that has passed through the flat tubes (61) of the fourth principal leeward bank block (92*d*) flows into the flat tubes (31) of the fourth principal windward bank block (52*d*). In addition, the refrigerant that has passed through the flat tubes (61) of the fifth principal leeward bank block (92*e*) flows into the flat tubes (31) of the fifth principal windward bank block (52*e*). In addition, the refrigerant that has passed through the flat tubes (61) of the sixth principal leeward bank block (92*f*) flows into the flat tubes (31) of the sixth principal windward bank block (52*f*).

The refrigerant flowing through the flat tubes (31) of each of the principal windward bank blocks (52*a*-52*f*) exchanges heat with the outdoor air supplied to the outdoor heat exchanger (23). The flows of the refrigerant that have passed through the twelve flat tubes (31) of each of the principal windward bank blocks (52*a*-52*f*) enter, and merge together in, the upper space (42) in the first windward header collecting pipe (40), and then passes through the gas connection pipe (102) to flow into the outdoor heat exchanger (23).

<Changes in Temperatures of Refrigerant and Air in Outdoor Heat Exchanger Functioning as Evaporator>

Figure 10:
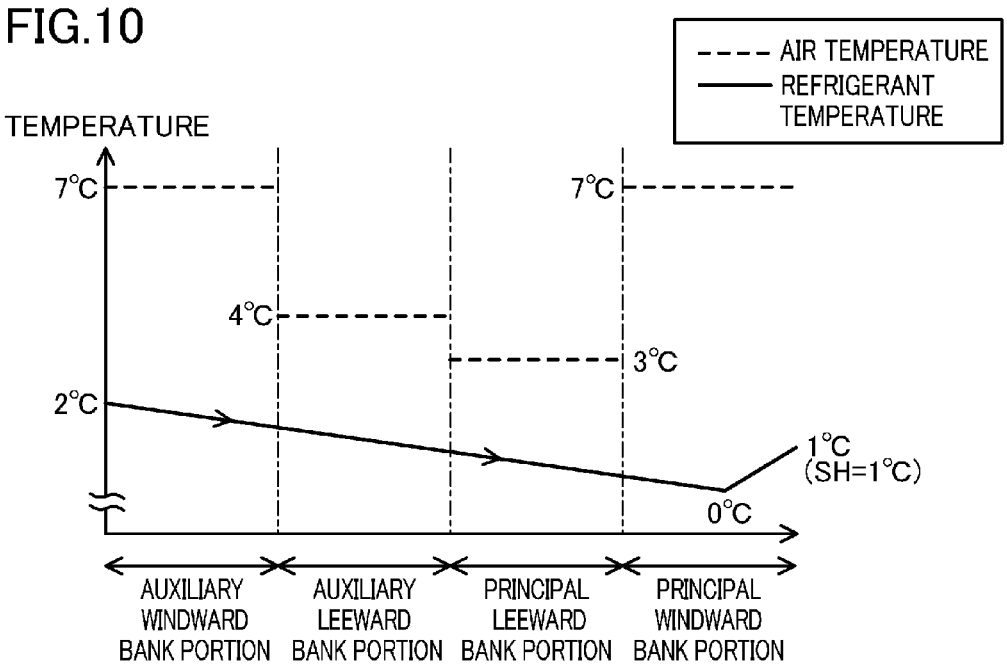
FIG. 10 is a graph showing changes in temperatures of a refrigerant and air in the outdoor heat exchanger of the first embodiment functioning as an evaporator.

FIG. 10 shows examples of changes in temperatures of air and a refrigerant in the outdoor heat exchanger (23) functioning as an evaporator.

As illustrated in FIG. 10, a gas-liquid two-phase refrigerant having a saturation temperature of 2° C. flows into the flat tubes (31) constituting the auxiliary windward bank portion (54). The saturation temperature of the refrigerant gradually decreases to 0° C. due to a pressure loss caused when the refrigerant passes through the flat tubes (31, 61). Then, the refrigerant is turned into a gas single phase state while flowing through the flat tubes (31) constituting the principal windward bank portion (51), and then the refrigerant having a temperature increased to 1° C. flows out of the flat tubes (31) constituting the principal windward bank portion (51).

On the other hand, air having 7° C. flows into the auxiliary windward heat exchange region (37) provided with the auxiliary windward bank portion (54) and the principal windward heat exchange region (35) provided with the principal windward bank portion (51). Also, air cooled to 4° C. in passing through the auxiliary windward heat exchange region (37) and flows into the auxiliary leeward heat exchange region (67) provided with the auxiliary leeward bank portion (94), and air cooled to 3° C. in passing through the principal windward heat exchange region (35) and flows into the principal leeward heat exchange region (65) provided with the principal leeward bank portion (91).

As can be seen from the foregoing, when the outdoor heat exchanger (23) of this embodiment functions as an evaporator, the temperature of the refrigerant becomes lower than that of the air in the entirety of the outdoor heat exchanger (23), and the amount of heat that the refrigerant absorbs from the air (i.e., the amount of heat absorbed by the refrigerant) is secured.

Here, when the outdoor heat exchanger (23) of this embodiment functions as an evaporator, the refrigerant passed through each of the auxiliary leeward bank blocks (95*a*-95*c*) temporarily flows into the principal communicating spaces (75*a*-75*f*) in the first leeward header collecting pipe (70), and thereafter is distributed to the twelve flat tubes (61) constituting the principal leeward bank blocks (92*a*-92*f*) (i.e., the plurality of flat tubes (61) arranged one above the other). During this time, the refrigerant flowing into the respective flat tubes (61) constituting the principal leeward bank blocks (92*a*-92*f*) does not necessarily have a uniform wetness, and the refrigerant having a low wetness may flow into some of the flat tubes (61).

However, the air exchanging heat with the refrigerant passing through the flat tubes (61) of the principal leeward bank blocks (92*a*-92*f*) has already been cooled by the refrigerant passing through the principal windward heat exchange region (35). Thus, the temperature difference between the refrigerant and air in the principal leeward heat exchange region (65) is smaller than that in the principal windward heat exchange region (35). Accordingly, even in some of the flat tubes (61) of the principal leeward bank blocks (92*a*-92*f*) into which the refrigerant having a low wetness flows, such a refrigerant generally keeps a gas-liquid two-phase state across the entire length of such flat tubes (61). Consequently, as can be seen from the foregoing, in the entirety of the outdoor heat exchanger (23) functioning as an evaporator, the refrigerant has a lower temperature than the air.

<Refrigerant Flow in Outdoor Heat Exchanger Functioning as Condenser>

During a cooling operation of the air conditioner (10), the outdoor heat exchanger (23) functions as a condenser. How the refrigerant flows in the outdoor heat exchanger (23) performing the cooling operation will be described below.

Figure 4:
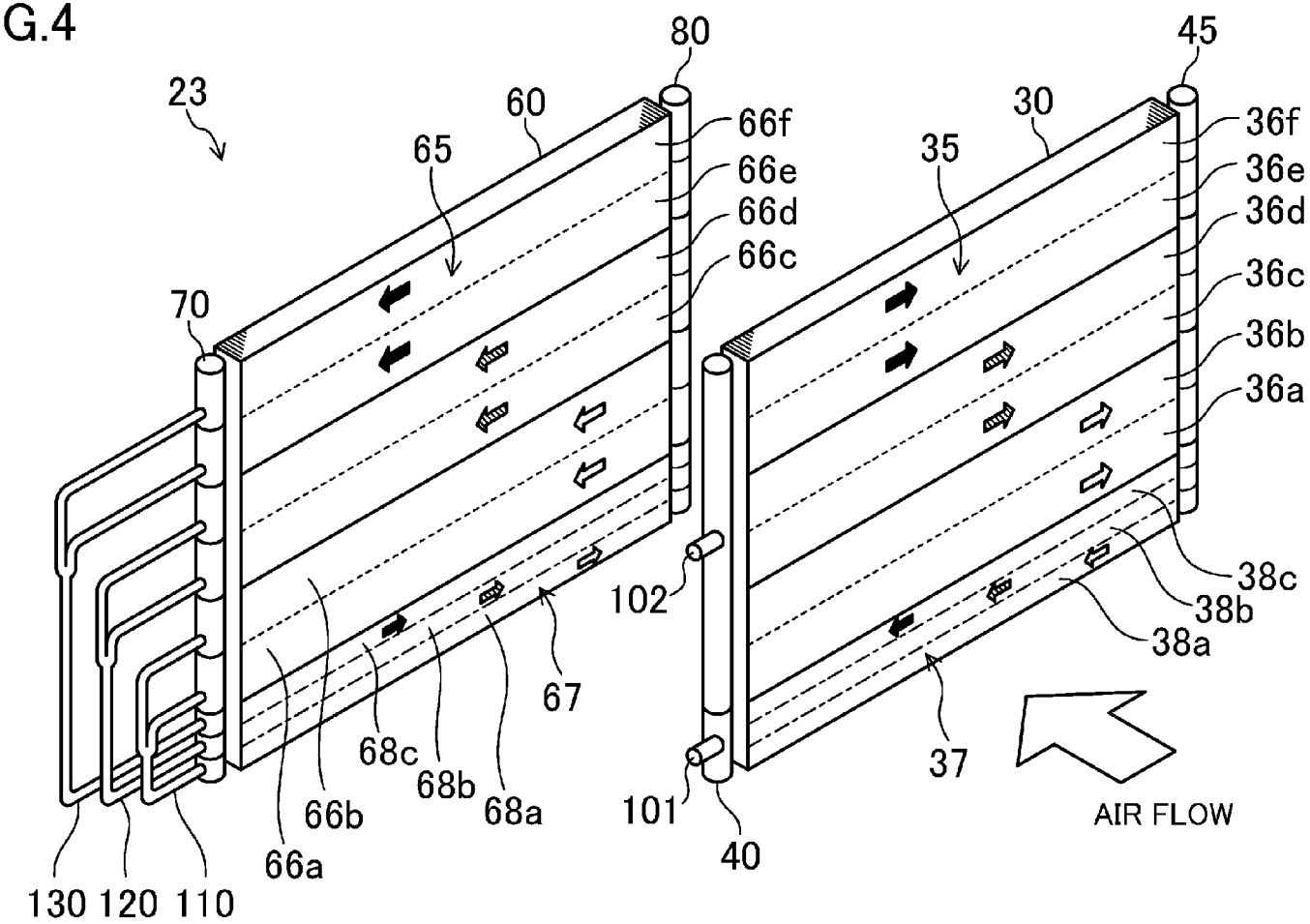
FIG. 4 is a general perspective view showing the outdoor heat exchanger of the first embodiment exploded into the windward heat exchanger unit and the leeward heat exchanger unit, and a refrigerant flow generated when the outdoor heat exchanger functions as a condenser.

A gas refrigerant discharged from the compressor (21) is supplied to the outdoor heat exchanger (23) through the pipe (18). As illustrated in FIG. 4, the refrigerant supplied from the pipe (18) to the gas connection pipe (102) passes through the flat tubes (31) constituting the principal windward bank portion (51), the flat tubes (61) constituting the principal leeward bank portion (91), the flat tubes (61) constituting the auxiliary leeward bank portion (94), and the flat tubes (31) constituting the auxiliary windward bank portion (54) in this order, and then flows into the pipe (17) through the liquid connection pipe (101).

The refrigerant flow in the outdoor heat exchanger (23) will be described in detail.

As illustrated in FIG. 5, the gas single phase refrigerant flowed from the gas connection pipe (102) to the upper space (42) in the first windward header collecting pipe (40) is diverged into the flat tubes (31) constituting each of the principal windward bank blocks. The refrigerant flowing through the flat tubes (31) of the principal windward bank blocks (52*a*-52*f*) exchanges heat with the outdoor air supplied to the outdoor heat exchanger (23). The refrigerant that has passed through the flat tubes (31) of each of the principal windward bank blocks (52*a*-52*f*) passes through the coupling space (47) and the coupling pipe (105) in the second windward header collecting pipe (45) in this order, and then flows into the coupling space (82) in the second leeward header collecting pipe (80).

As illustrated in FIG. 6, the refrigerant that has flowed into the coupling space (82) in the second leeward header collecting pipe (80) flows into the flat tubes (61) of the principal leeward bank blocks (92*a*-92*f*).

As can be seen from the foregoing, the flat tubes (31) of each of the principal windward bank blocks (52*a*-520 and the flat tubes (61) of each of the principal leeward bank blocks (92*a*-92*f*) are individually connected one by one through the coupling pipes (105) (see FIG. 8). Accordingly, the refrigerant that has passed through the flat tubes (31) of the first principal windward bank block (52*a*) flows into the flat tubes (61) of the first principal leeward bank block (92*a*). In addition, the refrigerant that has passed through the flat tubes (31) of the second principal windward bank block (52*b*) flows into the flat tubes (61) of the second principal leeward bank block (92*b*). In addition, the refrigerant that has passed through the flat tubes (31) of the third principal windward bank block (52*c*) flows into the flat tubes (61) of the third principal leeward bank block (92*c*). In addition, the refrigerant that has passed through the flat tubes (31) of the fourth principal windward bank block (52*d*) flows into the flat tubes (61) of the fourth principal leeward bank block (92*d*). In addition, the refrigerant that has passed through the flat tubes (31) of the fifth principal windward bank block (52*e*) flows into the flat tubes (61) of the fifth principal leeward bank block (92*e*). In addition, the refrigerant that has passed through the flat tubes (31) of the sixth principal windward bank block (52*f*) flows into the flat tubes (61) of the sixth principal leeward bank block (92*f*).

The refrigerant flowing through the flat tubes (61) of each of the principal leeward bank blocks (92*a*-92*f*) exchanges heat with the outdoor air that has passed through the principal windward heat exchange region (35). The refrigerant that has passed through the flat tubes (61) of each of the principal leeward bank blocks (92*a*-92*f*) flows into the associated one of the principal communicating spaces (75*a*-75*f*) in the first leeward header collecting pipe (70). The flows of the refrigerant that have passed through the flat tubes (61) of the first principal leeward bank block (92*a*) enter, and merge together in, the first principal communicating space (75*a*). The flows of the refrigerant that have passed through the flat tubes (61) of the second principal leeward bank block (92*b*) enter, and merge together in, the second principal communicating space (75*b*). The flows of the refrigerant that have passed through the flat tubes (61) of the third principal leeward bank block (92*c*) enter, and merge together in, the third principal communicating space (75*c*). The flows of the refrigerant that have passed through the flat tubes (61) of the fourth principal leeward bank block (92*d*) enter, and merge together in, the fourth principal communicating space (75*d*). The flows of the refrigerant that have passed through the flat tubes (61) of the fifth principal leeward bank block (92*e*) enter, and merge together in, the fifth principal communicating space (75*e*). The flows of the refrigerant that have passed through the flat tubes (61) of the sixth principal leeward bank block (92*f*) enter, and merge together in, the sixth principal communicating space (75*f*).

The refrigerant in the first principal communicating space (75*a*) and the refrigerant in the second principal communicating space (75*b*) flow into the first auxiliary communicating space (77*a*) through the first connection pipe (110). The refrigerant in the third principal communicating space (75*c*) and the refrigerant in fourth principal communicating space (75*d*) flow into the second auxiliary communicating space (77*b*) through the second connection pipe (120). The refrigerant in the fifth principal communicating space (75*e*) and the refrigerant in the sixth principal communicating space (75*f*) flow into the third auxiliary communicating space (77*c*) through the third connection pipe (130).

The refrigerant in each of the auxiliary communicating spaces (77*a*-77*c*) flows into the flat tubes (61) of the associated one of the auxiliary leeward bank blocks (95*a*-95*c*). The refrigerant in the first auxiliary communicating space (77*a*) flows into the flat tubes (61) of the first auxiliary leeward bank block (95*a*). The refrigerant in the second auxiliary communicating space (77*b*) flows into the flat tubes (61) of the second auxiliary leeward bank block (95*b*). The refrigerant in the third auxiliary communicating space (77*c*) flows into the flat tubes (61) of the third auxiliary leeward bank block (95*c*).

The refrigerant flowing through the flat tubes (61) of each of the auxiliary leeward bank blocks (95*a*-95*c*) exchanges heat with the outdoor air that has passed through the auxiliary windward heat exchange region (37). The refrigerant that has passed through the flat tubes (61) of each of the auxiliary leeward bank blocks (95*a*-95*c*) passes through the coupling space (82) and the coupling pipe (105) in the second leeward header collecting pipe (80) in this order, and then flows into the coupling space (47) in the second windward header collecting pipe (45).

As illustrated in FIG. 5, the refrigerant that has flowed into the coupling space (47) in the second windward header collecting pipe (45) flows into the flat tubes (31) of the auxiliary windward bank blocks (55*a*-55*c*).

As can be seen from the foregoing, the flat tubes (31) of each of the auxiliary windward bank blocks (55*a*-55*c*) and the flat tubes (61) of each of the auxiliary leeward bank blocks (95*a*-95*c*) are individually connected one by one through the coupling pipes (105) (see FIG. 8). Accordingly, the refrigerant passed through the flat tubes (61) of the first auxiliary leeward bank block (95*a*) flows into the flat tubes (31) of the first auxiliary windward bank block (55*a*). In addition, the refrigerant that has passed through the flat tubes (61) of the second auxiliary leeward bank block (95*b*) flows into the flat tubes (31) of the second auxiliary windward bank block (55*b*). In addition, the refrigerant that has passed through the flat tubes (61) of the third auxiliary leeward bank block (95*c*) flows into the flat tubes (31) of the third auxiliary windward bank block (55*c*).

The refrigerant flowing through the flat tubes (31) of the auxiliary windward bank blocks (55*a*-55*c*) exchanges heat with the outdoor air supplied to the outdoor heat exchanger (23). The refrigerant that has passed through the flat tubes (31) of each of the auxiliary windward bank blocks (55*a*-55*c*) flows into the associated one of the communicating chambers (151-153). The flows of the refrigerant that have passed through the flat tubes (31) of the first auxiliary windward bank block (55*a*) enter, and merge together in, the first communicating chamber (151). The flows of the refrigerant that have passed through the flat tubes (31) of the second auxiliary windward bank block (55*b*) enter, and merge together in, the second communicating chamber (152). The flows of the refrigerant that have passed through the flat tubes (31) of the third auxiliary windward bank block (55*c*) enter, and merge together in, the third communicating chamber (153). The refrigerants in the communicating chambers (151-153) enter, and merge together in the mixing chamber (154), and then flow out of the outdoor heat exchanger (23) after passing through the liquid connection pipe (101).

<Changes in Temperatures of Refrigerant and Air in Outdoor Heat Exchanger as Functioning Condenser>

Figure 11:
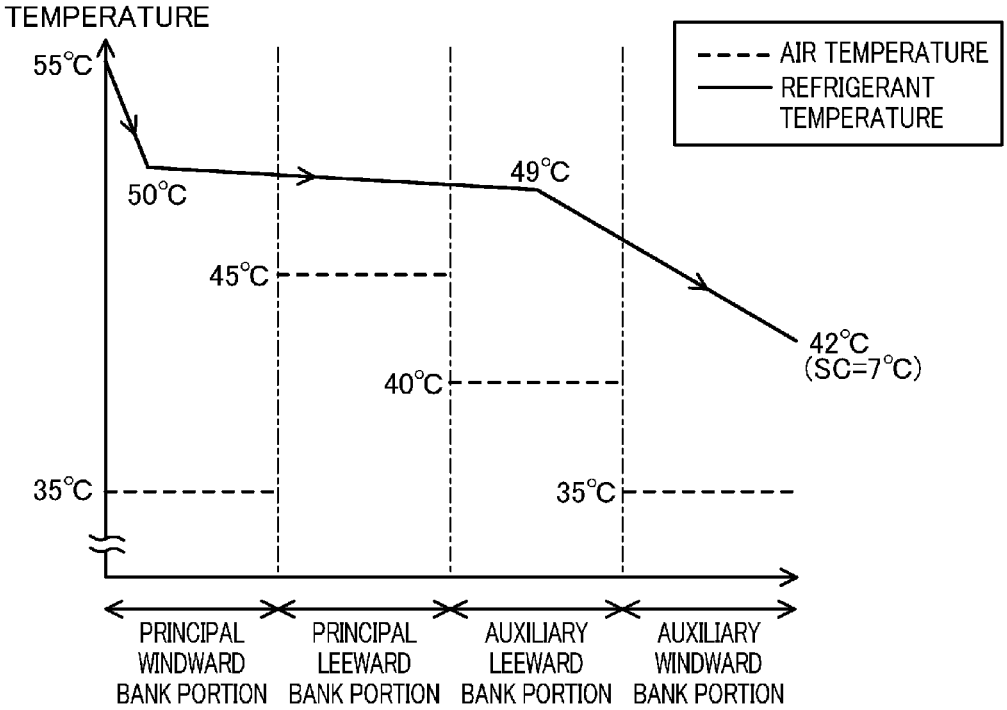
FIG. 11 is a graph showing changes in temperatures of a refrigerant and air in the outdoor heat exchanger of the first embodiment functioning as a condenser.

FIG. 11 shows examples of changes in temperatures of air and refrigerant in the outdoor heat exchanger (23) functioning as a condenser.

As illustrated in FIG. 11, the superheated gas refrigerant having 55° C. flows into the flat tubes (31) constituting the principal windward bank portion (51). This refrigerant is turned into a saturated gas refrigerant having 50° C. while passing through the flat tubes (31) constituting the principal windward bank portion (51), and thereafter condenses gradually. The saturation temperature of the refrigerant gradually decreases to 49° C. due to a pressure loss caused when the refrigerant passes through the flat tubes (31, 61). Then, the refrigerant is turned into a liquid single phase state while passing through the flat tubes (31) constituting the auxiliary windward bank portion (54), and then the refrigerant having a temperature decreased to 42° C. flows out of the flat tubes (31) constituting the auxiliary leeward bank portion (94).

On the other hand, air having 35° C. flows into the auxiliary windward heat exchange region (37) provided with the auxiliary windward bank portion (54) and the principal windward heat exchange region (35) provided with the principal windward bank portion (51). Also, air heated to 45° C. in passing through the principal windward heat exchange region (35) flows into the principal leeward heat exchange region (65) provided with the principal leeward bank portion (91), air heated to 40° C. in passing through the auxiliary windward heat exchange region (37) flows into the auxiliary leeward heat exchange region (67) provided with the auxiliary leeward bank portion (94).

As can be seen from the foregoing, when the outdoor heat exchanger (23) of this embodiment functions as a condenser, the refrigerant has a higher temperature than the air in the entirety of the outdoor heat exchanger (23), and the amount of heat that the refrigerant dissipates to the air (i.e., the amount of heat dissipated by the refrigerant) is secured.

—Advantages of First Embodiment—

In the outdoor heat exchanger (23) of this embodiment, the auxiliary windward bank portion (54), the auxiliary leeward bank portion (94), the first leeward header collecting pipe (70), the principal leeward bank portion (91), and the principal windward bank portion (51) are arranged in series in the refrigerant flow path.

When the outdoor heat exchanger (23) of this embodiment functions as an evaporator, the refrigerant flows from the auxiliary windward bank portion (54) to the principal windward bank portion (51) in this order. In other words, after passing through the flat tubes (61) of the principal leeward bank portion (91), the refrigerant passes through the flat tubes (31) of the principal windward bank portion (51).

The refrigerant flowing through the flat tubes (61) of the principal leeward bank portion (91) exchanges heat with the air cooled in the principal windward heat exchange region (35). Thus, as can be seen from the foregoing, even in some of the flat tubes (61) of the principal leeward bank portion (91) into which the refrigerant having a low wetness flows, such a refrigerant generally remains in a gas-liquid two-phase state throughout the length of such flat tubes (61). Accordingly, in the entirety of the outdoor heat exchanger (23) of this embodiment, the refrigerant has a lower temperature than the air (see FIG. 10), and consequently, the amount of heat absorbed by the refrigerant may be fully secured.

Also, when the outdoor heat exchanger (23) of this embodiment functions as a condenser, the refrigerant flows from the principal windward bank portion (51) to the auxiliary windward bank portion (54) in this order. Thus, in the entirety of the outdoor heat exchanger (23) of this embodiment, the refrigerant has a higher temperature than the air (see FIG. 11), and consequently, the amount of heat dissipated by the refrigerant may be fully secured.

In this manner, according to this embodiment, the outdoor heat exchanger (23) including the windward tube bank (50) and the leeward tube bank (90) allows for exhibiting both the performance as an evaporator and the performance as a condenser.

Here, when the outdoor heat exchanger (23) of this embodiment functions as an evaporator, the gas-liquid two-phase refrigerant supplied to the outdoor heat exchanger (23) is distributed to each of the flat tubes (61) of the principal leeward bank portion (91) after passing through the auxiliary windward bank portion (54) and the auxiliary leeward bank portion (94) in this order.

On the other hand, the auxiliary windward bank portion (54) and the auxiliary leeward bank portion (94) are constituted of the flat tubes (31, 61) significantly fewer in number than the flat tubes (31, 61) of the principal leeward bank portion (91). Further, in general, due to the location of the outdoor fan (15), the flow rate of the air passing near the lower end of the outdoor heat exchanger (23) is relatively low. Thus, the amount of heat absorbed by the refrigerant is relatively small when the refrigerant passes through the auxiliary windward bank portion (54) and the auxiliary leeward bank portion (94), and thus the decrease in the wetness of the refrigerant during that time is relatively small.

As can be seen from the foregoing, in the outdoor heat exchanger (23) of this embodiment, the refrigerant flowing from the auxiliary leeward bank portion (94) to the principal leeward bank portion (91) keeps its wetness relatively high. In general, the higher the wetness of a gas-liquid two-phase refrigerant distributed to a plurality of flat tubes arranged one above the other is, the more the difference in the wetness of the refrigerant flowing into each of the flat tubes is reduced, and thus the difference in the mass flow rate of the refrigerant flowing into each flat tube also tends to be reduced. Accordingly, even if the refrigerant passed through the auxiliary bank portions (54, 94) flows into the principal leeward bank portion (91) just like in the outdoor heat exchanger (23) of this embodiment, the differences in the wetness and mass flow rate of the refrigerant flowing into each of the flat tubes (61) of the principal leeward bank portion (91) do not differ so much from such differences in the case where the gas-liquid two-phase refrigerant supplied to the outdoor heat exchanger (23) flows directly into the principal leeward bank portion (91).

Also, in the outdoor heat exchanger (23) of this embodiment, the flat tubes (31) constituting the principal windward bank blocks (52*a*-521) and the flat tubes (61) constituting the principal leeward bank blocks (92*a*-92*f*) paired up with the principal windward bank blocks (52*a*-52*f*) are individually connected one by one. Thus, the number of distribution of the refrigerant to the plurality of flat tubes (31, 61) in the refrigerant flow path of the outdoor heat exchanger (23) is reducible, thereby making the mass flow rate of the refrigerant flowing in each of the flat tubes (31, 61) uniform easily.

Also, in the outdoor heat exchanger (23) of this embodiment, the flat tubes (31) constituting the auxiliary windward bank blocks (55*a*-55*c*) and the flat tubes (61) constituting the auxiliary leeward bank blocks (95*a*-95*c*) paired up with the auxiliary windward bank blocks (55*a*-55*c*) are individually connected one by one. Thus, the number of distribution of the refrigerant to the plurality of flat tubes (31, 61) in the refrigerant flow path of the outdoor heat exchanger (23) is reducible, thereby making the mass flow rate of the refrigerant flowing in each of the flat tubes (31, 61) uniform easily.

Also, in the outdoor heat exchanger (23) of this embodiment, the principal leeward bank block groups (93*a*-93*c*) each paired with the associated one of the auxiliary leeward bank blocks (95*a*-95*c*) are constituted of the plurality of principal leeward bank blocks (92*a*-92*f*). Thus, the number of the flat tubes (61) constituting each of the principal leeward bank blocks (92*a*-92*f*) is reduced in comparison with the case in which one of the auxiliary leeward bank blocks (95*a*-95*c*) is paired with one of the principal leeward bank blocks (92*a*-92*f*), and consequently the height of the principal communicating spaces (75*a*-75*f*) paired with the principal leeward bank blocks (92*a*-92*f*) is reduced.

On the other hands, the lower the height of the principal communicating spaces (75*a*-75*f*) is, the smaller the difference between the mass flow rate of the refrigerant flowing into the flat tubes (61) near the upper ends of the principal communicating spaces (75*a*-75*f*) and the mass flow rate of the refrigerant flowing into the flat tubes (61) near the lower end thereof is. Thus, according to this embodiment, when the outdoor heat exchanger (23) functions as an evaporator, the difference in the mass flow rate of the refrigerant flowing into each of the flat tubes (61) constituting the principal leeward bank blocks (92*a*-92*f*) is reducible.

Second Embodiment

A second embodiment will be described. An outdoor heat exchanger (23) of this embodiment is obtained by modifying the configurations of the second windward header collecting pipe (45) and the second leeward header collecting pipe (80) of the outdoor heat exchanger (23) of the first embodiment. Here, the differences between the outdoor heat exchanger (23) of this embodiment and the outdoor heat exchanger (23) of the first embodiment will be described.

Figure 12:
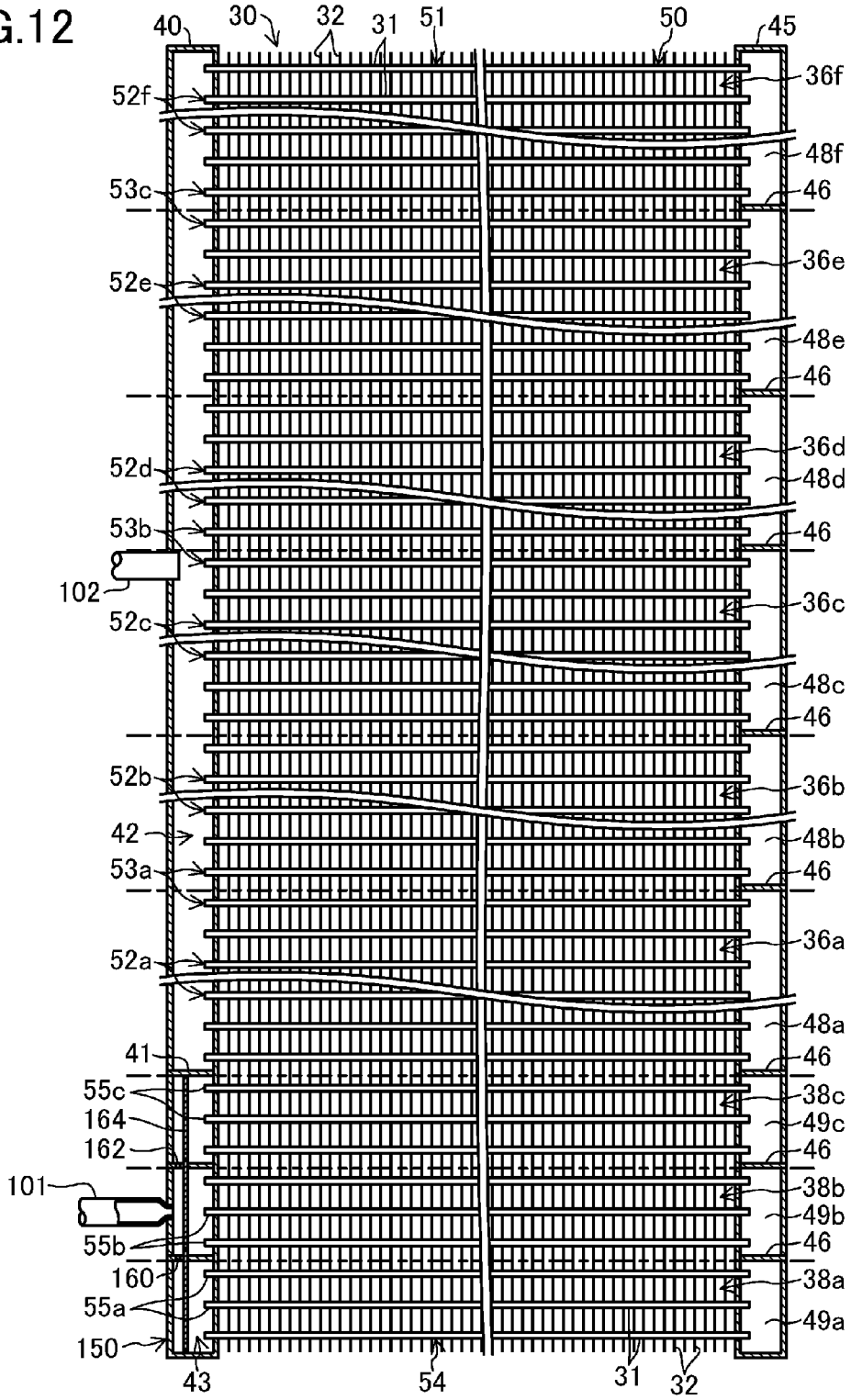
FIG. 12 is a partial cross-sectional view showing a windward heat exchanger unit of a second embodiment as viewed from the front.

As illustrated in FIG. 12, only eight partition plates (46) are provided in the second windward header collecting pipe (45) of this embodiment. In the second windward header collecting pipe (45), the partition plates (46) are arranged one by one at a boundary between the first and second auxiliary windward heat exchange portions (38*a*) and (38*b*), a boundary between the second and third auxiliary windward heat exchange portion (38*b*) and (38*c*), a boundary between the third auxiliary windward heat exchange portion (38*c*) and the first principal windward heat exchange portion (36*a*), a boundary between the first and second principal windward heat exchange portions (36*a*) and (36*b*), a boundary between the second and third principal windward heat exchange portions (36*b*) and (36*c*), a boundary between the third and fourth principal windward heat exchange portions (36*c*) and (36*d*), a boundary between the fourth and fifth principal windward heat exchange portions (36*d*) and (36*e*), and a boundary between the fifth and sixth principal windward heat exchange portions (36*e*) and (36*f*).

The inner space of the second windward header collecting pipe (45) is partitioned into three auxiliary coupling spaces (49*a*-49*c*) and six principal coupling spaces (48*a*-48*f*) by the eight partition plates (46).

The first auxiliary coupling space (49*a*) communicates with all the flat tubes (31) constituting the first auxiliary windward bank block (55*a*). The second auxiliary coupling space (49*b*) communicates with all the flat tubes (31) constituting the second auxiliary windward bank block (55*b*). The third auxiliary coupling space (49*c*) communicates with all the flat tubes (31) constituting the third auxiliary windward bank block (55*c*).

The first principal coupling space (48*a*) communicates with all the flat tubes (31) constituting the first principal windward bank block (52*a*). The second principal coupling space (48*b*) communicates with all the flat tubes (31) constituting the second principal windward bank block (52*b*). The third principal coupling space (48*c*) communicates with all the flat tubes (31) constituting the third principal windward bank block (52*c*). The fourth principal coupling space (48*d*) communicates with all the flat tubes (31) constituting the fourth principal windward bank block (52*d*). The fifth principal coupling space (48*e*) communicates with all the flat tubes (31) constituting the fifth principal windward bank block (52*e*). The sixth principal coupling space (480 communicates with all the flat tubes (31) constituting the sixth principal windward bank block (52*f*).

Figure 13:
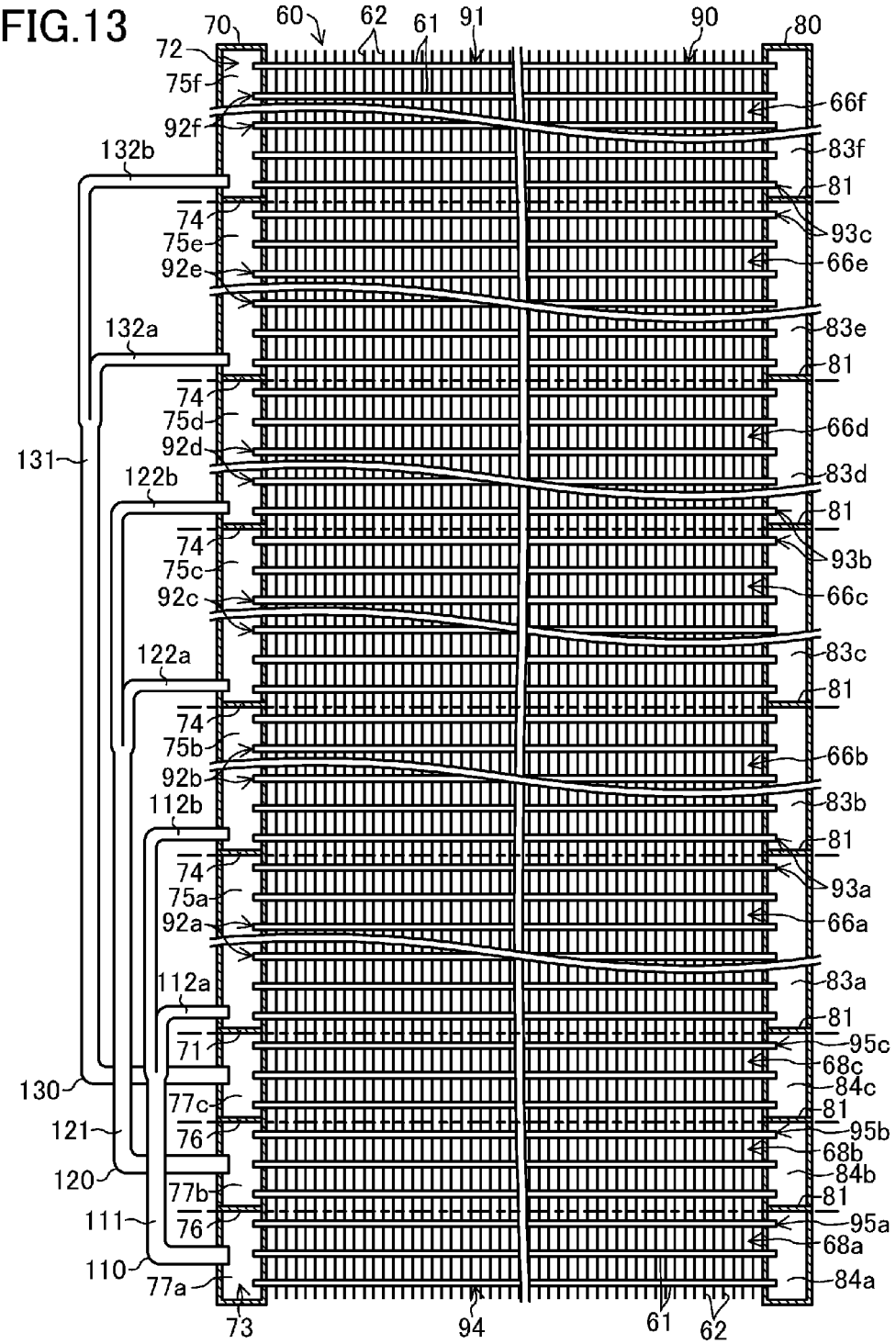
FIG. 13 is a partial cross-sectional view showing a leeward heat exchanger unit of the second embodiment as viewed from the front.

As illustrated in FIG. 13, only eight partition plates (81) are provided in the second leeward header collecting pipe (80) of this embodiment. In the second leeward header collecting pipe (80), the partition plates (46) are arranged one by one at a boundary between the first and second auxiliary leeward heat exchange portions (68*a*) and (68*b*), a boundary between the second and third auxiliary leeward heat exchange portions (68*b*) and (68*c*), a boundary between the third auxiliary leeward heat exchange portion (68*c*) and the first principal leeward heat exchange portion (66*a*), a boundary between the first and second principal leeward heat exchange portions (66*a*) and (66*b*), a boundary between the second and third principal leeward heat exchange portions (66*b*) and (66*c*), a boundary between the third and fourth principal leeward heat exchange portions (66*c*) and (66*d*), a boundary between the fourth and fifth principal leeward heat exchange portions (66*d*) and (66*e*), and a boundary between the fifth and sixth principal leeward heat exchange portions (66*e*) and (66*f*).

The inner space of the second leeward header collecting pipe (80) is partitioned into three auxiliary coupling spaces (84*a*-84*c*) and six principal coupling spaces (83*a*-83*f*) by the eight partition plates (81).

The first auxiliary coupling space (84*a*) communicates with all the flat tubes (61) constituting the first auxiliary leeward bank block (95*a*). The second auxiliary coupling space (84*b*) communicates with all the flat tubes (61) constituting the second auxiliary leeward bank block (95*b*). The third auxiliary coupling space (84*c*) communicates with all the flat tubes (61) constituting the third auxiliary leeward bank block (95*c*).

The first principal coupling space (83*a*) communicates with all the flat tubes (61) constituting the first principal leeward bank block (92*a*). The second principal coupling space (83*b*) communicates with all the flat tubes (61) constituting the second principal leeward bank block (92*b*). The third principal coupling space (83*c*) communicates with all the flat tubes (61) constituting the third principal leeward bank block (92*c*). The fourth principal coupling space (83*d*) communicates with all the flat tubes (61) constituting the fourth principal leeward bank block (92*d*). The fifth principal coupling space (83*e*) communicates with all the flat tubes (61) constituting the fifth principal leeward bank block (92*e*). The sixth principal coupling space (83*f*) communicates with all the flat tubes (61) constituting the sixth principal leeward bank block (92*f*).

Although not shown, the auxiliary coupling spaces (49*a*-49*c*) in the second windward header collecting pipe (45) and the auxiliary coupling spaces (84*a*-84*c*) in the second leeward header collecting pipe (80) are connected one by one respectively through the coupling pipes (105).

The first auxiliary coupling space (49*a*) in the second windward header collecting pipe (45) is connected to the first auxiliary coupling space (84*a*) in the second leeward header collecting pipe (80) through the single coupling pipe (105). The second auxiliary coupling space (49*b*) in the second windward header collecting pipe (45) is connected to the second auxiliary coupling space (84*b*) in the second leeward header collecting pipe (80) through the single coupling pipe (105). The third auxiliary coupling space (49*c*) in the second windward header collecting pipe (45) is connected to the third auxiliary coupling space (84*c*) in the second leeward header collecting pipe (80) through the single coupling pipe (105).

The first principal coupling space (48*a*) in the second windward header collecting pipe (45) is connected to the first principal coupling space (83*a*) in the second leeward header collecting pipe (80) through the single coupling pipe (105). The second principal coupling space (48*b*) in the second windward header collecting pipe (45) is connected to the second principal coupling space (83*b*) in the second leeward header collecting pipe (80) through the single coupling pipe (105). The third principal coupling space (48*c*) in the second windward header collecting pipe (45) is connected to the third principal coupling space (83*c*) in the second leeward header collecting pipe (80) through the single coupling pipe (105). The fourth principal coupling space (48*d*) in the second windward header collecting pipe (45) is connected to the fourth principal coupling space (83*d*) in the second leeward header collecting pipe (80) through the single coupling pipe (105). The fifth principal coupling space (48*e*) in the second windward header collecting pipe (45) is connected to the fifth principal coupling space (83*e*) in the second leeward header collecting pipe (80) through the single coupling pipe (105). The sixth principal coupling space (480 in the second windward header collecting pipe (45) is connected to the sixth principal coupling space (83*f*) in the second leeward header collecting pipe (80) through the single coupling pipe (105).

When the outdoor heat exchanger (23) of this embodiment functions as an evaporator, the refrigerant that has passed through the flat tubes (31) of each of the auxiliary windward bank blocks (55*a*-55*c*) passes through the associated one of the auxiliary coupling spaces (49*a*-49*c*) in the second windward header collecting pipe (45), the associated one of the coupling pipes (105), and the associated one of the auxiliary coupling spaces (84*a*-84*c*) in the second leeward header collecting pipe (80) in this order, and flows into the flat tubes (61) of the associated one of the auxiliary leeward bank blocks (95*a*-95*c*). Also, the refrigerant that has passed through the flat tubes (61) of each of the principal leeward bank blocks (92*a*-92*f*) passes through the associated one of the principal coupling spaces (83*a*-83*f*) in the second leeward header collecting pipe (80), the associated one of the coupling pipes (105), and the associated one of the principal coupling spaces (48*a*-48*f*) in the second windward header collecting pipe (45) in this order, and flows into the flat tubes (31) of the associated one of the principal windward bank blocks (52*a*-52*f*).

On the other hand, when the outdoor heat exchanger (23) of this embodiment functions as a condenser, the refrigerant that has passed through the flat tubes (31) of each of the principal windward bank blocks (52*a*-52*f*) passes through the associated one of the principal coupling spaces (48*a*-48*f*) in the second windward header collecting pipe (45), the associated one of the coupling pipes (105), the associated one of the principal coupling spaces (83*a*-83*f*) in the second leeward header collecting pipe (80) in this order, and flows into the flat tubes (61) of the associated one of the principal leeward bank blocks (92*a*-92*f*). Also, the refrigerant that has passed through the flat tubes (61) of each of the auxiliary leeward bank blocks (95*a*-95*c*) passes through the associated one of auxiliary coupling spaces (84*a*-84*c*) in the second leeward header collecting pipe (80), the associated one of the coupling pipes (105), and the associated one of auxiliary coupling spaces (49*a*-49*c*) in the second windward header collecting pipe (45) in this order, and flows into the flat tubes (31) of the associated one of the auxiliary windward bank blocks (55*a*-55*c*).

Third Embodiment

A third embodiment will be described. An outdoor heat exchanger (23) of this embodiment is obtained by modifying the configuration of the outdoor heat exchanger (23) of the first embodiment. Here, the difference between the outdoor heat exchanger (23) of this embodiment and the outdoor heat exchanger (23) of the first embodiment will be described.

Figure 14:
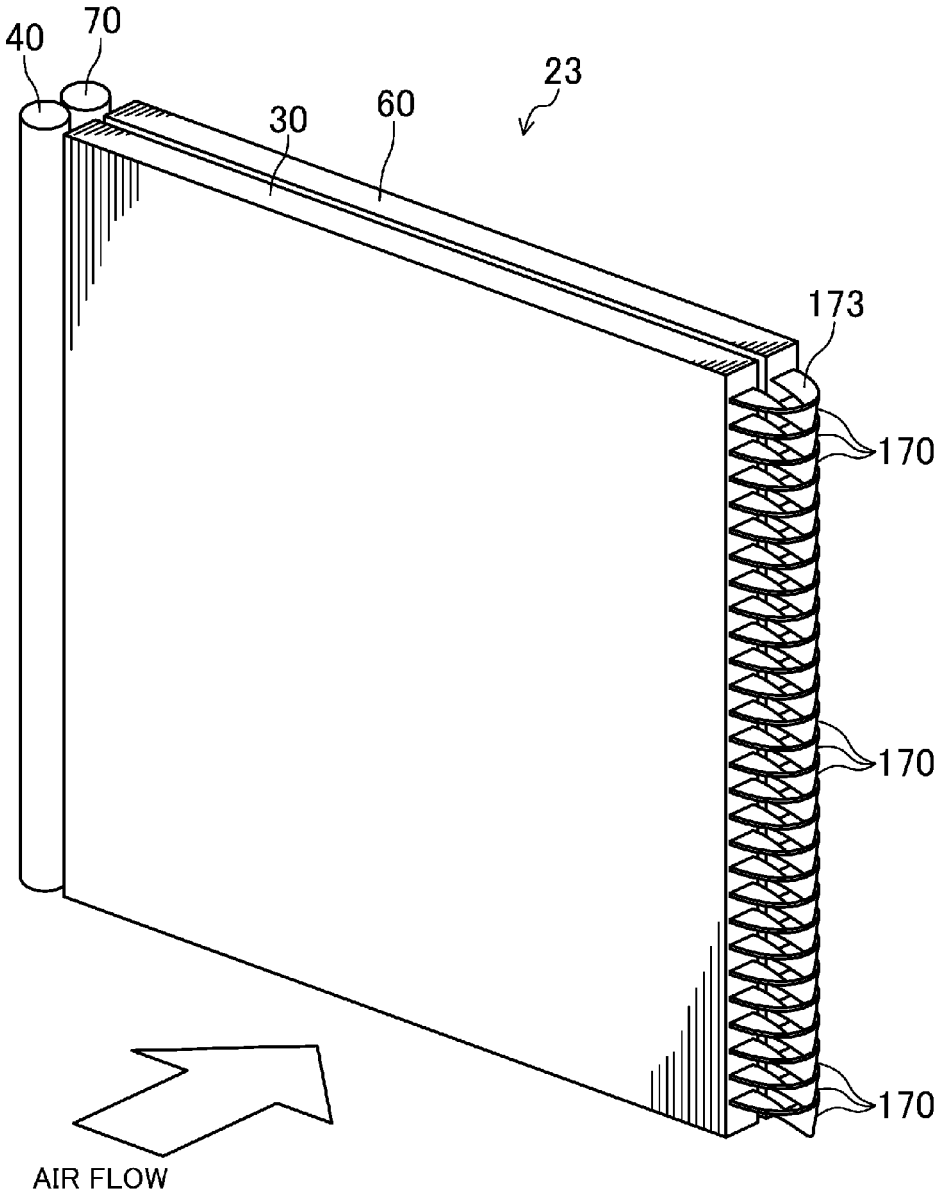
FIG. 14 is a general perspective view of an outdoor heat exchanger of a third embodiment.
Figure 15:
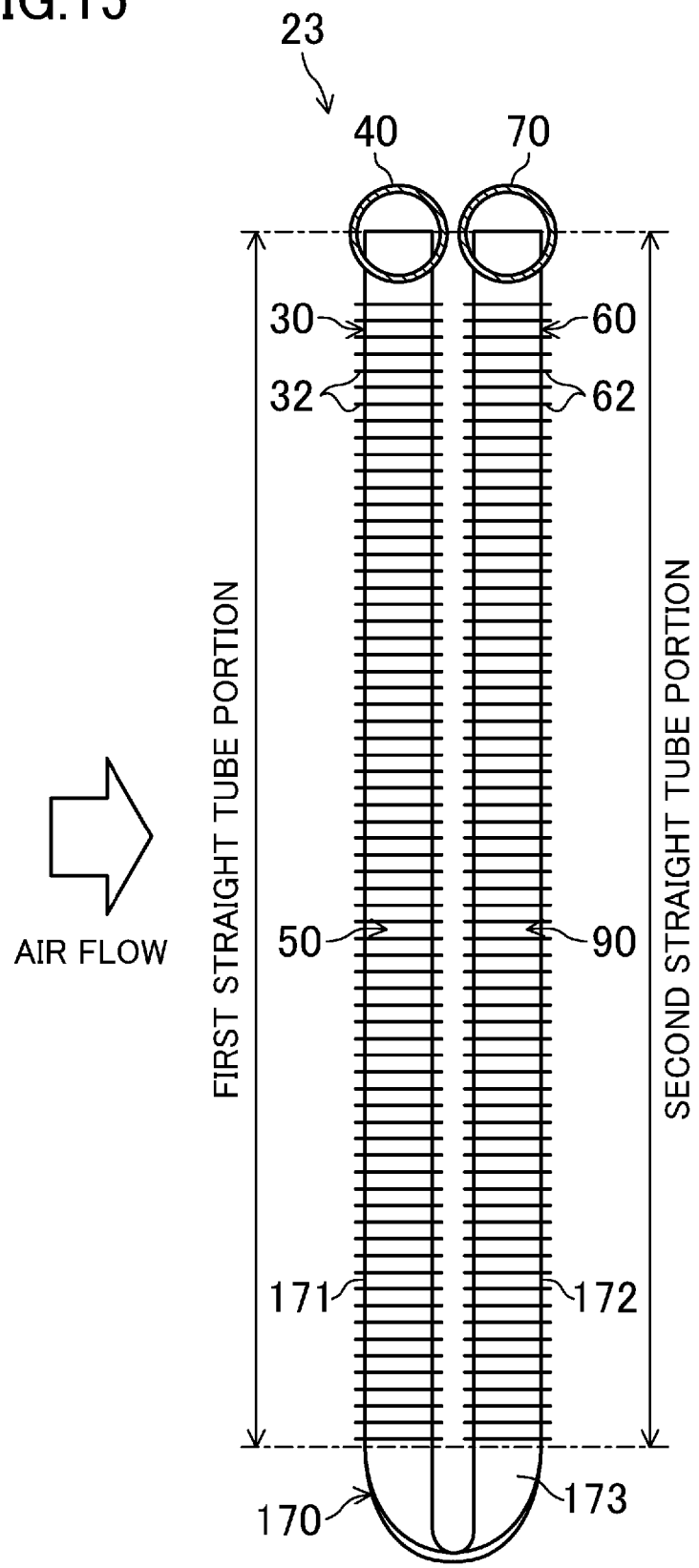
FIG. 15 is a partial cross-sectional view showing the outdoor heat exchanger of the third embodiment as viewed from above.

As illustrated in FIGS. 14 and 15, the outdoor heat exchanger (23) of this embodiment does not have the second windward and leeward header collecting pipes (45) and (80), and the flat tubes (31) constituting the windward tube bank (50) and the flat tubes (61) constituting the leeward tube bank (90) are integrated together.

Specifically, in the outdoor heat exchanger (23) of this embodiment, a plurality of flat tubes (170) each bent in a U-shaped form are arranged one above the other. Each of the flat tubes (170) is made by bending a straight flat tube into a U-shaped form, and includes two straight tube portions (171, 172) and a curved tube portion (173) coupling the two straight tube portions (171, 172) together. In each of the flat tubes (170), the two straight tube portions (171, 172) are substantially parallel with each other.

In the outdoor heat exchanger (23) of this embodiment, the straight tube portions (171, 172) of the flat tubes (170) vertically adjacent to each other have flat surfaces facing each other, and axial directions substantially parallel to each other. The axial directions of the straight tube portions (171, 172) of one of the flat tubes (170) vertically adjacent to each other are substantially parallel with the axial directions of the straight tube portions (171, 172) of the other one of the flat tubes (170) vertically adjacent to each other. Also, in each of the flat tubes (170), the first straight tube portion (171) has an opening end connected to the first windward header collecting pipe (40), and the second straight tube portion (172) has an opening end connected to the first leeward header collecting pipe (70). Then, in the outdoor heat exchanger (23) of this embodiment, the first straight tube portions (171) of the flat tubes (170) constitute the windward tube bank (50), and the second straight tube portions (172) of the flat tubes (170) constitute the leeward tube bank (90). In other words, the first straight tube portions (171) of the flat tubes (170) correspond to the flat tubes (31) constituting the windward tube bank (50) of the first embodiment, and the second straight tube portions (172) of the flat tubes (170) correspond to the flat tubes (61) constituting the leeward tube bank (90) of the first embodiment.

Thus, in each of the flat tubes (170) provided in the outdoor heat exchanger (23) of this embodiment, the two straight tube portions (171, 172) are connected together through the single curved tube portion (173). Accordingly, in the outdoor heat exchanger (23) of this embodiment, just like in the outdoor heat exchanger (23) of the first embodiment, the flat tubes constituting the windward tube bank (50) and the flat tubes constituting the leeward tube bank (90) are connected together one by one.

Fourth Embodiment

A fourth embodiment will be described. An outdoor heat exchanger (23) of this embodiment is obtained by modifying the configuration of the outdoor heat exchanger (23) of the first embodiment. Here, the difference between the outdoor heat exchanger (23) of this embodiment and the outdoor heat exchanger (23) of the first embodiment will be described.

Figure 16:
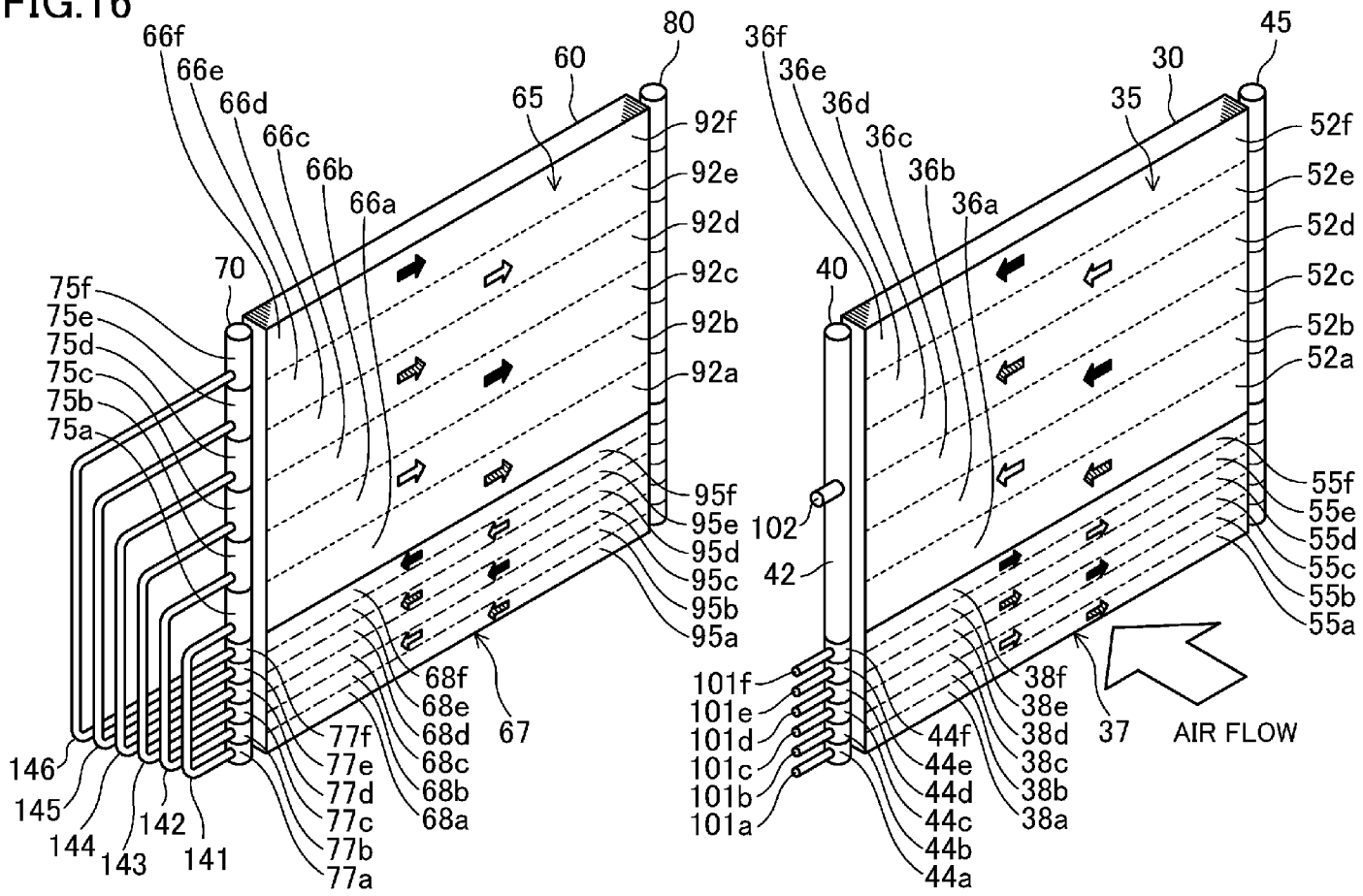
FIG. 16 is a general perspective view showing an outdoor heat exchanger of a fourth embodiment exploded into a windward heat exchanger unit and a leeward heat exchanger unit.

As illustrated in FIG. 16, in the outdoor heat exchanger (23) of this embodiment, the auxiliary windward heat exchange region (37) is vertically divided into six auxiliary windward heat exchange portions (38*a*-38*f*), and the auxiliary leeward heat exchange region (67) is divided into six auxiliary leeward heat exchange portions (68*a*-68*f*). In other words, in the outdoor heat exchanger (23) of this embodiment, the principal windward heat exchange portions (36*a*-36*f*), the auxiliary windward heat exchange portions (38*a*-38*f*), the principal leeward heat exchange portions (66*a*-66*f*), and the auxiliary leeward heat exchange portion (68*a*-68*f*) are equal in number.

<Configuration for Windward Heat Exchanger Unit>

The difference between the windward heat exchanger unit (30) of this embodiment and the first embodiment will be described.

The auxiliary windward heat exchange region (37) is formed with the first auxiliary windward heat exchange portion (38*a*), the second auxiliary windward heat exchange portion (38*b*), the third auxiliary windward heat exchange portion (38*c*), the fourth auxiliary windward heat exchange portion (38*d*), the fifth auxiliary windward heat exchange portion (38*e*), and the sixth auxiliary windward heat exchange portion (38*f*) in this order from bottom to top. The auxiliary windward heat exchange portions (38*a*-38*f*) have the same number of flat tubes (31).

The flat tubes (31) provided in the first auxiliary windward heat exchange portion (38*a*) constitute the first auxiliary windward bank block (55*a*). The flat tubes (31) provided in the second auxiliary windward heat exchange portion (38*b*) constitute the second auxiliary windward bank block (55*b*). The flat tubes (31) provided in the third auxiliary windward heat exchange portion (38*c*) constitute the third auxiliary windward bank block (55*c*). The flat tubes (31) provided in the fourth auxiliary windward heat exchange portion (38*d*) constitute the fourth auxiliary windward bank block (55*d*). The flat tubes (31) provided in the fifth auxiliary windward heat exchange portion (38*e*) constitute the fifth auxiliary windward bank block (55*e*). The flat tubes (31) provided in the sixth auxiliary windward heat exchange portion (380 constitute the sixth auxiliary windward bank block (55*f*).

The lower space (43) in the first windward header collecting pipe (40) is vertically divided into six auxiliary communicating spaces (44*a*-44*f*). In other words, the first auxiliary communicating space (44*a*), the second auxiliary communicating space (44*b*), the third auxiliary communicating space (44*c*), the fourth auxiliary communicating space (44*d*), the fifth auxiliary communicating space (44*e*), and the sixth auxiliary communicating space (44*f*) are formed below the partition plate (41) in the first windward header collecting pipe (40) in this order from bottom to top.

The first auxiliary communicating space (44*a*) communicates with the flat tubes (31) constituting the first auxiliary windward bank block (55*a*). The second auxiliary communicating space (44*b*) communicates with the flat tubes (31) constituting the second auxiliary windward bank block (55*b*). The third auxiliary communicating space (44*c*) communicates with the flat tubes (31) constituting the third auxiliary windward bank block (55*c*). The fourth auxiliary communicating space (44*d*) communicates with the flat tubes (31) constituting the fourth auxiliary windward bank block (55*d*). The fifth auxiliary communicating space (44*e*) communicates with the flat tubes (31) constituting the fifth auxiliary windward bank block (55*e*). The sixth auxiliary communicating space (44*f*) communicates with the flat tubes (31) constituting the sixth auxiliary windward bank block (55*f*).

Six liquid connection pipes (101*a*-101*f*) are attached to the first windward header collecting pipe (40). One end of the first liquid connection pipe (101*a*) communicates with the first auxiliary communicating space (44*a*). One end of the second liquid connection pipe (101*b*) communicates with the second auxiliary communicating space (44*b*). One end of the third liquid connection pipe (101*c*) communicates with the third auxiliary communicating space (44*c*). One end of the fourth liquid connection pipe (101*d*) communicates with the fourth auxiliary communicating space (44*d*). One end of the fifth liquid connection pipe (101*e*) communicates with the fifth auxiliary communicating space (44*e*). One end of the sixth liquid connection pipe (101*f*) communicates with the sixth auxiliary communicating space (44*f*).

Although not shown in FIG. 16, the other end of each of the liquid connection pipes (101*a*-101*f*) is connected to the pipe (17) of the refrigerant circuit (20) through the distributor. During a heating operation of the air conditioner (10), this distributor distributes the refrigerant passed through the expansion valve (24) to each of the liquid connection pipes (101*a*-101*f*).

Although not shown in FIG. 16, space inside the second windward header collecting pipe (45) is divided into as many coupling spaces (47) as the flat tubes (31) constituting the windward tube bank (50). Each of the coupling spaces (47) communicates with the associated one of the flat tubes (31). The outdoor heat exchanger (23) of this embodiment and the outdoor heat exchanger (23) of the first embodiment have the common configurations described in this paragraph.

<Configuration for Leeward Heat Exchanger Unit>

The difference between the leeward heat exchanger unit (60) of this embodiment and that of the first embodiment will be described.

The auxiliary leeward heat exchange region (67) is formed with the first auxiliary leeward heat exchange portion (68*a*), the second auxiliary leeward heat exchange portion (68*b*), the third auxiliary leeward heat exchange portion (68*c*), the fourth auxiliary leeward heat exchange portion (68*d*), the fifth auxiliary leeward heat exchange portion (68*e*), and the sixth auxiliary leeward heat exchange portion (68*f*) arranged in this order from bottom to top. The auxiliary leeward heat exchange portions (68*a*-68*f*) have the same number of flat tubes (61).

The flat tubes (61) provided in the first auxiliary leeward heat exchange portion (68*a*) constitute the first auxiliary leeward bank block (95*a*). The flat tubes (61) provided in the second auxiliary leeward heat exchange portion (68*b*) constitute the second auxiliary leeward bank block (95*b*). The flat tubes (61) provided in third auxiliary leeward heat exchange portion (68*c*) constitute the third auxiliary leeward bank block (95*c*). The flat tubes (61) provided in the fourth auxiliary leeward heat exchange portion (68*d*) constitute the fourth auxiliary leeward bank block (95*d*). The flat tubes (61) provided in fifth auxiliary leeward heat exchange portion (68*e*) constitute the fifth auxiliary leeward bank block (95*e*). The flat tubes (61) provided in the sixth auxiliary leeward heat exchange portion (68*f*) constitute the sixth auxiliary leeward bank block (95*f*).

The lower space (73) in the first leeward header collecting pipe (70) is vertically divided into six auxiliary communicating spaces (77*a*-77*c*). In other words, the first auxiliary communicating space (77*a*), the second auxiliary communicating space (77*b*), the third auxiliary communicating space (77*c*), the fourth auxiliary communicating space (77*d*), the fifth auxiliary communicating space (77*e*), and the sixth auxiliary communicating space (77*f*) are formed below the partition plate (71) in the first leeward header collecting pipe (70) in this order from bottom to top.

The first auxiliary communicating space (77*a*) communicates with the flat tubes (61) constituting the first auxiliary leeward bank block (95*a*). The second auxiliary communicating space (77*b*) communicates with the flat tubes (61) constituting the second auxiliary leeward bank block (95*b*). The third auxiliary communicating space (77*c*) communicates with the flat tubes (61) constituting the third auxiliary leeward bank block (95*c*). The fourth auxiliary communicating space (77*d*) communicates with the flat tubes (61) constituting the fourth auxiliary leeward bank block (95*d*). The fifth auxiliary communicating space (77*e*) communicates with the flat tubes (61) constituting the fifth auxiliary leeward bank block (95*e*). The sixth auxiliary communicating space (77*f*) communicates with the flat tubes (61) constituting the sixth auxiliary leeward bank block (95*f*).

Six connection pipes (141-146) are attached to the first leeward header collecting pipe (70). The first connection pipe (141) has an end communicating with the first auxiliary communicating space (77*a*), and the other end communicating with the first principal communicating space (75*a*), thereby connecting the first auxiliary leeward bank block (95*a*) to the first principal leeward bank block (92*a*). The second connection pipe (142) has an end communicating with the second auxiliary communicating space (77*b*), and the other end communicating with the second principal communicating space (75*b*), thereby connecting the second auxiliary leeward bank block (95*b*) to the second principal leeward bank block (92*b*). The third connection pipe (143) has an end communicating with the third auxiliary communicating space (77*c*), and the other end communicating with the third principal communicating space (75*c*), thereby connecting the third auxiliary leeward bank block (95*c*) to the third principal leeward bank block (92*c*). The fourth connection pipe (144) has an end communicating with the fourth auxiliary communicating space (77*d*), and the other end communicating with the fourth principal communicating space (75*d*), thereby connecting the fourth auxiliary leeward bank block (95*d*) to the fourth principal leeward bank block (92*d*). The fifth connection pipe (145) has an end communicating with the fifth auxiliary communicating space (77*e*), and the other end communicating with the fifth principal communicating space (75*e*), thereby connecting the fifth auxiliary leeward bank block (95*e*) to the fifth principal leeward bank block (92*e*). The sixth connection pipe (146) has an end communicating with the sixth auxiliary communicating space (77*f*), and the other end communicating with the sixth principal communicating space (75*f*), thereby connecting the sixth auxiliary leeward bank block (95*f*) to the sixth principal leeward bank block (92*f*).

Although not shown in FIG. 16, the inner space in the second leeward header collecting pipe (80) is divided into as many coupling spaces (82) as the flat tubes (61) constituting the leeward tube bank (90). Each of the coupling spaces (82) communicates with the associated one of the flat tubes (61). Each of the coupling spaces (82) in the second leeward header collecting pipe (80) is connected to the associated one of the coupling spaces (47) in the second windward header collecting pipe (45) through the coupling pipe (105). The outdoor heat exchanger (23) of this embodiment and the outdoor heat exchanger (23) of the first embodiment have the common configurations described in this paragraph.

As can be seen from the foregoing, in the outdoor heat exchanger (23) of this embodiment, the first auxiliary windward bank block (55*a*), the first auxiliary leeward bank block (95*a*), the first principal leeward bank block (92*a*), and the first principal windward bank block (52*a*) are connected together in series in this order. The second auxiliary windward bank block (55*b*), the second auxiliary leeward bank block (95*b*), the second principal leeward bank block (92*b*), and the second principal windward bank block (52*b*) are connected together in series in this order. The third auxiliary windward bank block (55*c*), the third auxiliary leeward bank block (95*c*), the third principal leeward bank block (92*c*), and the third principal windward bank block (52*c*) are connected together in series in this order. The fourth auxiliary windward bank block (55*d*), the fourth auxiliary leeward bank block (95*d*), the fourth principal leeward bank block (92*d*), and the fourth principal windward bank block (52*d*) are connected together in series in this order. The fifth auxiliary windward bank block (55*e*), the fifth auxiliary leeward bank block (95*e*), the fifth principal leeward bank block (92*e*), and the fifth principal windward bank block (52*e*) are connected together in series in this order. The sixth auxiliary windward bank block (55*f*), the sixth auxiliary leeward bank block (95*f*), the sixth principal leeward bank block (92*f*), and the sixth principal windward bank block (52*f*) are connected in series in this order.

<Refrigerant Flow in Outdoor Heat Exchanger>

When the outdoor heat exchanger (23) of this embodiment functions as an evaporator, the refrigerant that has passed through the expansion valve (24) flows into the six liquid connection pipes (101*a*-101*f*). Thereafter, the refrigerant flows in a direction indicated by arrows shown in FIG. 16. That is, the refrigerant flows through the auxiliary windward bank block (55*a*-55*f*), the auxiliary leeward bank block (95*a*-95*f*), the principal leeward bank block (92*a*-92*f*), and the principal windward bank block (52*a*-52*f*) connected together in this order.

When the outdoor heat exchanger (23) of this embodiment functions as a condenser, the refrigerant discharged from the compressor (21) flows into the gas connection pipe (102). Thereafter, the refrigerant flows in a direction opposite to the direction indicated by the arrows shown in FIG. 16. That is, the refrigerant flows through the principal windward bank block (52*a*-52*f*), the principal leeward bank block (92*a*-92*f*), the auxiliary leeward bank block (95*a*-95*f*), and the auxiliary windward bank block (55*a*-55*f*) connected together in this order.

Here, in the outdoor heat exchanger (23) functioning as an evaporator according to the first embodiment, the refrigerant that has passed through each of the auxiliary leeward bank blocks (95*a*-95*c*) is distributed to the associated two of the principal leeward bank blocks (92*a*-92*f*). Thus, the outdoor heat exchanger (23) of the first embodiment needs a contrivance for distributing the refrigerant uniformly from each of the auxiliary leeward bank blocks (95*a*-95*c*) to the associated two of the principal leeward bank blocks (92*a*-92*f*).

On the other hand, in the outdoor heat exchanger (23) functioning as an evaporator according to this embodiment, the refrigerant that has passed through each of the auxiliary leeward bank blocks (95*a*-95*f*) flows into the associated one of the principal leeward bank blocks (92*a*-92*f*). Thus, the outdoor heat exchanger (23) of this embodiment does not need any additional contrivance for sending the refrigerant from the auxiliary leeward bank blocks (95*a*-95*f*) to the principal leeward bank blocks (92*a*-92*f*) as long as each of the auxiliary leeward bank blocks (95*a*-95*f*) and the associated one of the principal leeward bank blocks (92*a*-92*f*) are connected via the associated one of the liquid connection pipes (101*a*-101*f*). Thus, according to this embodiment, the flow rate of the refrigerant flowing in the principal leeward bank blocks (92*a*-92*f*) is readily made uniform.

Other Embodiments

Figure 17:
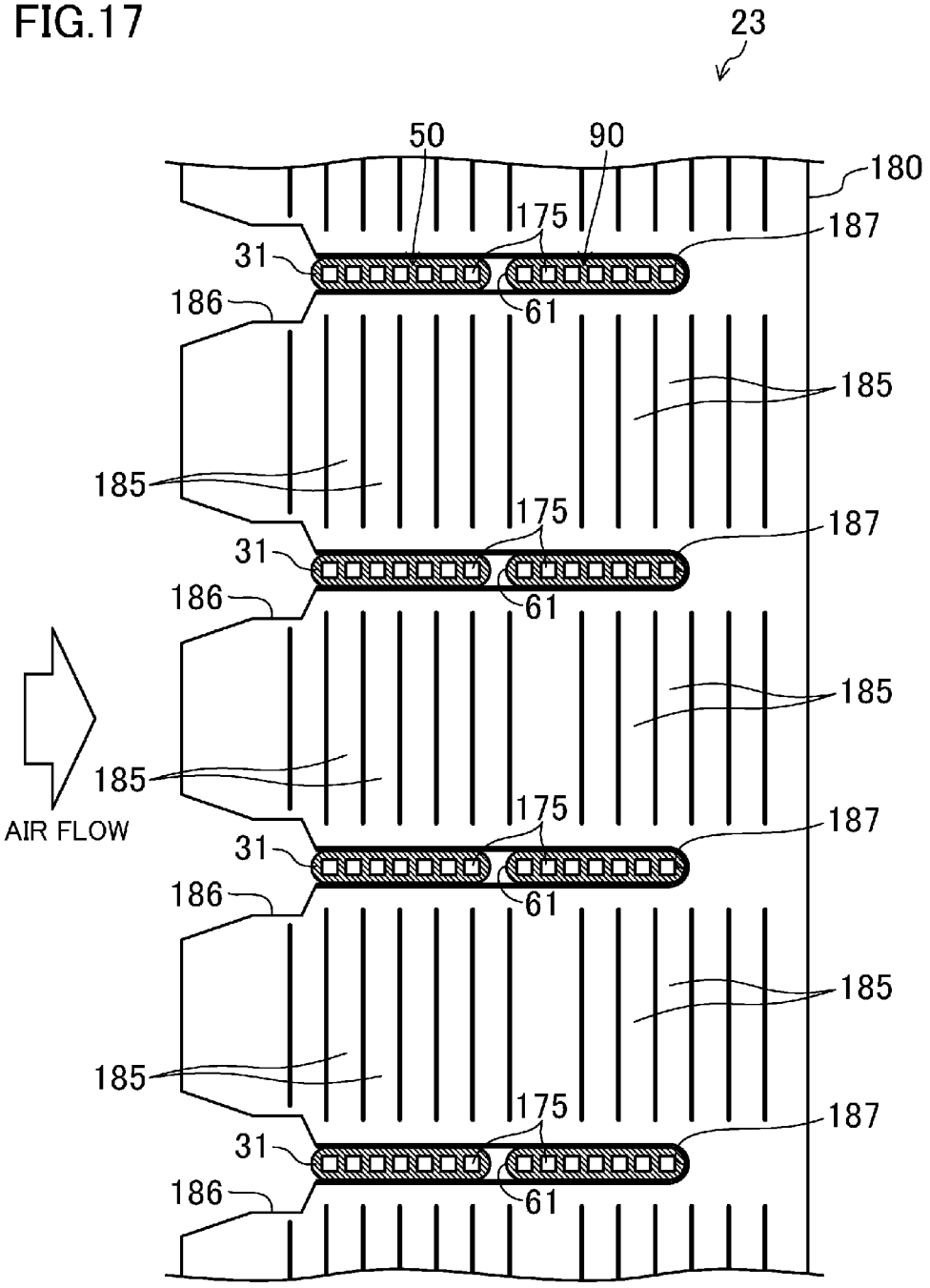
FIG. 17 is a cross-sectional view corresponding to FIG. 7, showing an outdoor heat exchanger of another embodiment.
Figure 18A:
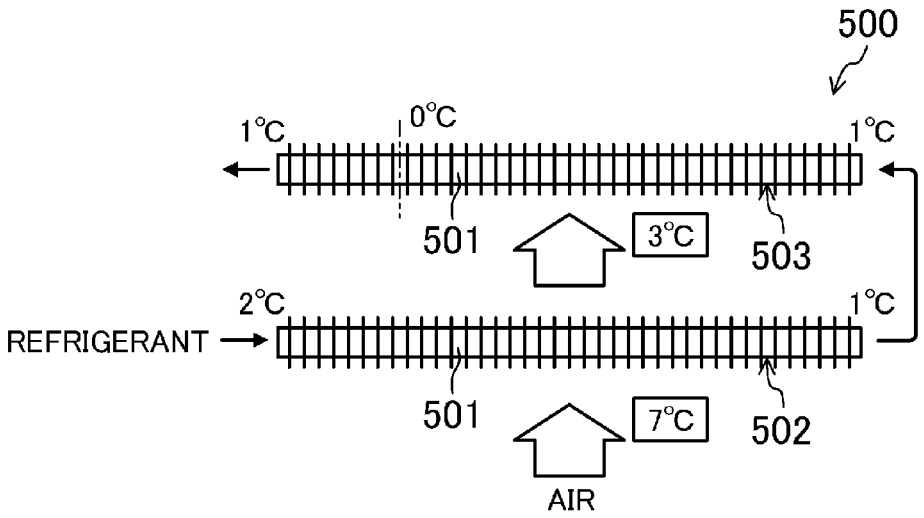
Figure 18B:
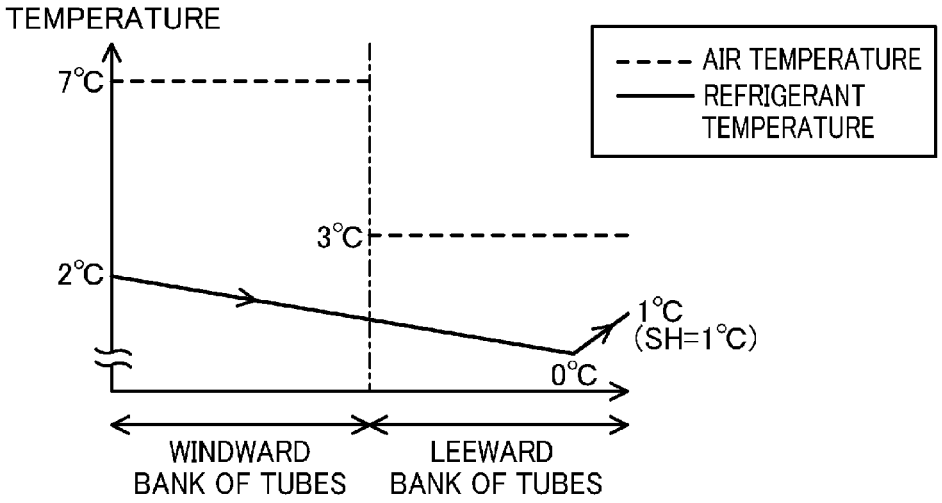
Figure 19:
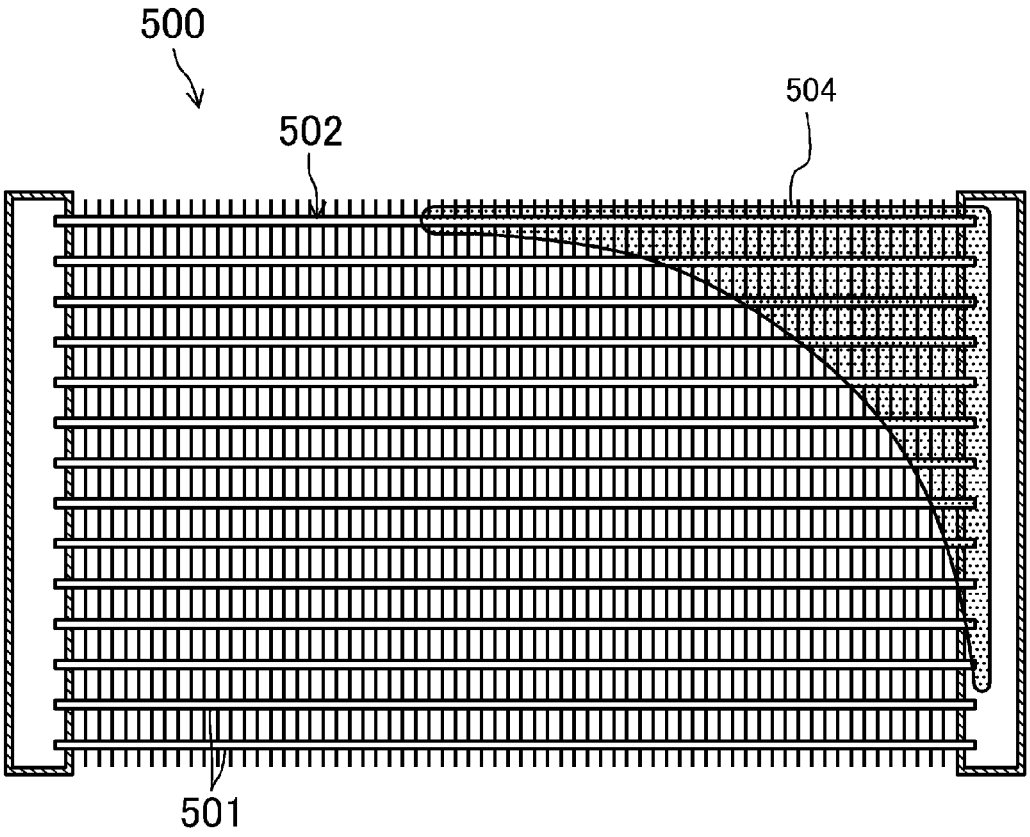
FIG. 19 is a general front view of a conventional heat exchanger functioning as an evaporator.
Figure 20A:
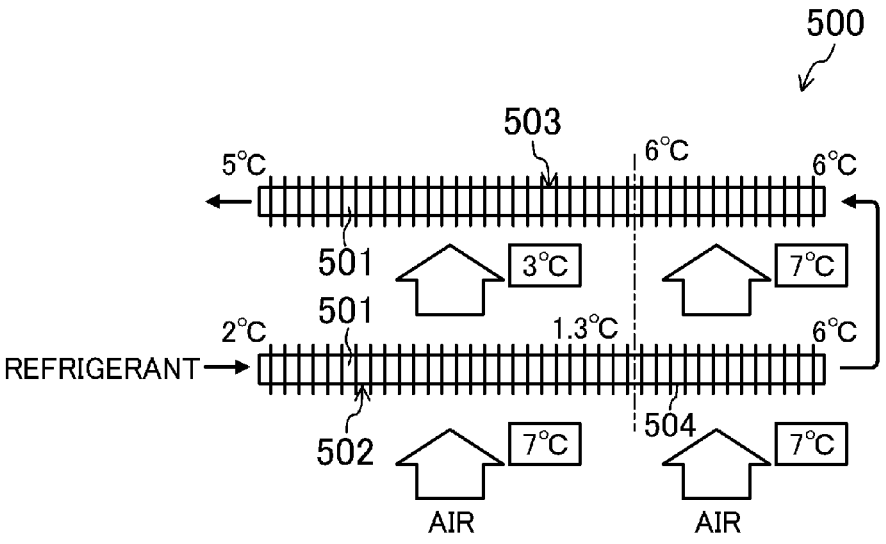
Figure 20B:
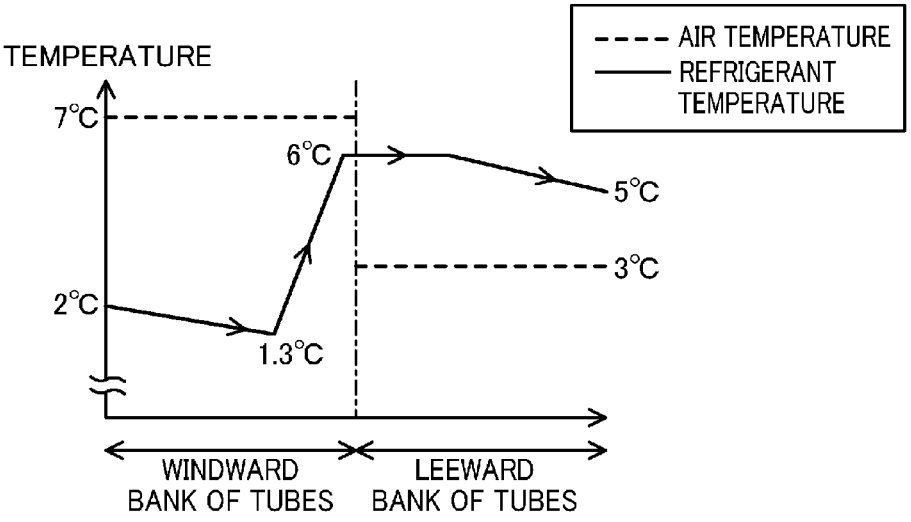

As illustrated in FIG. 17, in the outdoor heat exchanger (23) of each of the above-described embodiments, both the flat tube (31) constituting the windward tube bank (50) and the flat tube (61) constituting the leeward tube bank (90) may be jointed to a single fin (180). Specifically, in the outdoor heat exchanger (23) of this variation, both the flat tube (31) constituting the windward tube bank (50) and the flat tube (61) constituting the leeward tube bank (90) are arranged in each of the tube insertion portions (187) arranged in the fin (180) at regular intervals in the axial direction of the flat tubes (31, 61).

Also, the outdoor heat exchanger (23) of each of the above-described embodiments may be provided with wavy fins instead of the plate-like fins (32, 62, 180). Such fins are so-called corrugated fins, which have a vertically meandering shape. These wavy fins are arranged one by one between the flat tubes (31, 61, 170) vertically adjacent to each other.

INDUSTRIAL APPLICABILITY

As can be seen from the foregoing, the present invention is useful for a heat exchanger including flat tubes and fins for allowing a refrigerant and air to exchange heat with each other.

DESCRIPTION OF REFERENCE CHARACTERS

10 Air Conditioner
23 Outdoor Heat Exchanger (Heat Exchanger)
31 Flat Tube
32 Fin
50 Windward Tube Bank
51 Principal Windward Bank Portion
52*a*-52*f* First-Sixth Principal Windward Bank Block

55*a*-55*c* First-Third Auxiliary Windward Bank Block
54 Auxiliary Windward Bank Portion
61 Flat Tube
62 Fin
70 First Leeward Header Collecting Pipe (Header Collecting Pipe)
75*a*-75*f* First-Sixth Principal Communicating Space
77*a*-77*c* First-Third Auxiliary Communicating Space
90 Leeward Tube Bank
91 Principal Leeward Bank Portion
92*a*-92*f* First-Sixth Principal Leeward Bank Block
93*a*-93*c* First-Third Principal Leeward Bank Block Group
94 Auxiliary Leeward Bank Portion
95*a*-95*c* First-Third Auxiliary Leeward Bank Block

The invention claimed is:

1. A heat exchanger configured to exchange heat between a refrigerant flowing through a plurality of flat tubes and air, the heat exchanger comprising:

a windward tube bank and a leeward tube bank arranged in a flow direction of the air, each of which being constituted of the plurality of flat tubes arranged one above the other; and fins jointed to the flat tubes, wherein the windward tube bank is divided into a principal windward bank portion and an auxiliary windward bank portion, each of which being constituted of the plurality of the flat tubes arranged one above the other, the auxiliary windward bank portion is located below the principal windward bank portion, and is constituted of the flat tubes smaller in number than the flat tubes of the principal windward bank portion, the leeward tube bank is divided into a principal leeward bank portion and an auxiliary leeward bank portion, each of which being constituted of the plurality of flat tubes arranged one above the other, the auxiliary leeward bank portion is located below the principal leeward bank portion, and is constituted of the flat tubes smaller in number than the flat tubes of the principal leeward bank portion, the heat exchanger further comprises a header collecting pipe connected to one end of each of the flat tubes constituting the principal leeward bank portion to form principal communicating spaces communicating with the plurality of flat tubes, the auxiliary windward bank portion, the auxiliary leeward bank portion, the header collecting pipe, the principal leeward bank portion, and the principal windward bank portion are arranged in series in a refrigerant flow path, the refrigerant flows from the auxiliary windward bank portion to the principal windward bank portion in this order when the heat exchanger functions as an evaporator, and the refrigerant flows from the principal windward bank portion to the auxiliary windward bank portion in this order when the heat exchanger functions as a condenser.

2. The heat exchanger of claim 1, wherein the number of the flat tubes constituting the principal windward bank portion is equal to the number of the flat tubes constituting the principal leeward bank portion, and the number of the flat tubes constituting the auxiliary windward bank portion is equal to the number of the flat tubes constituting the auxiliary leeward bank portion.

3. The heat exchanger of claim 1, wherein the principal windward bank portion is further divided into a plurality of principal windward bank blocks, each of which being constituted of the plurality of the flat tubes arranged one above the other, the principal leeward bank portion is further divided into a plurality of principal leeward bank blocks, each of which being constituted of the plurality of flat tubes arranged one above the other, the number of the principal windward bank blocks is equal to the number of the principal leeward bank blocks, and the principal windward bank blocks and the principal leeward bank blocks form mutually different pairs, in each of which the principal windward bank block and the principal leeward bank block are arranged in series in the refrigerant flow path.

4. The heat exchanger of claim 3, wherein in each of the mutually different pairs, the number of the flat tubes constituting the principal windward bank block is equal to the number of the flat tubes constituting the principal leeward bank block.

5. The heat exchanger of claim 4, wherein in each of the mutually different pairs, the flat tubes constituting the principal windward bank block and the flat tubes constituting the principal leeward bank block are individually connected one by one.

6. The heat exchanger of claim 3, wherein the header collecting pipe is formed with as many the principal communicating spaces as the principal leeward bank blocks, and the principal communicating spaces and the principal leeward bank blocks form mutually different pairs, in each of which the principal communicating space communicates with the flat tubes constituting the principal leeward bank block.

7. The heat exchanger of claim 1, wherein the auxiliary windward bank portion is further divided into a plurality of auxiliary windward bank blocks, each of which being constituted of the plurality of the flat tubes arranged one above the other, the auxiliary leeward bank portion is further divided into a plurality of auxiliary leeward bank blocks, each of which being constituted of the plurality of flat tubes arranged one above the other, the number of the auxiliary windward bank blocks is equal to the number of the auxiliary leeward bank blocks, the auxiliary windward bank blocks and the auxiliary leeward bank blocks form mutually different pairs, and the auxiliary windward bank block and the auxiliary leeward bank block in each of the mutually different pairs are arranged in series in the refrigerant flow path.

8. The heat exchanger of claim 7, wherein in each of the mutually different pairs, the number of the flat tubes constituting the auxiliary windward bank block is equal to the number of the flat tubes constituting the auxiliary leeward bank block.

9. The heat exchanger of claim 8, wherein in each of the mutually different pairs, the flat tubes constituting the auxiliary windward bank block and the flat tubes constituting the auxiliary leeward bank block are individually connected one by one.

10. The heat exchanger of claim 7, wherein the header collecting pipe is further formed with a plurality of auxiliary communicating spaces each communicating with the flat tubes constituting the auxiliary leeward bank portion, the number of the auxiliary communicating spaces is equal to the number of the auxiliary leeward bank blocks, each of the auxiliary leeward bank blocks is paired with an associated one of the auxiliary communicating spaces, and in each of the pairs of the auxiliary communicating spaces and the auxiliary leeward bank blocks, the auxiliary communicating space communicates with the flat tubes constituting the auxiliary leeward bank block.

11. The heat exchanger of claim 1, wherein the principal leeward bank portion is further divided into a plurality of principal leeward bank blocks, each of which being constituted of the plurality of flat tubes arranged one above the other, the auxiliary leeward bank portion is further divided into a plurality of auxiliary leeward bank blocks, each of which being constituted of the plurality of flat tubes arranged one above the other, the header collecting pipe is formed with as many the principal communicating spaces as the principal leeward bank blocks, and the principal communicating spaces and the principal leeward bank blocks form mutually different pairs, in each of which the principal communicating space communicates with the flat tubes constituting the principal leeward bank block.

12. The heat exchanger of claim 11, wherein the principal leeward bank portion is formed with principal leeward bank block groups, each of which being constituted of the plurality of principal leeward bank blocks, the number of the principal leeward bank block groups is equal to the number of the auxiliary leeward bank blocks, the principal leeward bank block groups and the auxiliary leeward bank blocks form mutually different pairs, and in each of the mutually different pairs, the auxiliary leeward bank block is connected to the principal communicating space associated with the principal leeward bank block of the principal leeward bank block group.

13. The heat exchanger of claim 12, wherein the plurality of principal leeward bank blocks constituting each of the principal leeward bank block groups are vertically adjacent to each other.

14. The heat exchanger of claim 11, wherein the number of the principal leeward bank blocks is equal to the number of the auxiliary leeward bank blocks, the principal leeward bank blocks and the auxiliary leeward bank blocks form mutually different pairs, in each of which the principal leeward bank block and the auxiliary leeward bank block are arranged in series in the refrigerant flow path.

15. An air conditioner, comprising:

a refrigerant circuit provided with the heat exchanger of claim 1, wherein a refrigeration cycle is performed by circulating a refrigerant in the refrigerant circuit.

16. The heat exchanger of claim 2, wherein the principal windward bank portion is further divided into a plurality of principal windward bank blocks, each of which being constituted of the plurality of the flat tubes arranged one above the other, the principal leeward bank portion is further divided into a plurality of principal leeward bank blocks, each of which being constituted of the plurality of flat tubes arranged one above the other, the number of the principal windward bank blocks is equal to the number of the principal leeward bank blocks, and the principal windward bank blocks and the principal leeward bank blocks form mutually different pairs, in each of which the principal windward bank block and the principal leeward bank block are arranged in series in the refrigerant flow path.

17. The heat exchanger of claim 16, wherein the header collecting pipe is formed with as many the principal communicating spaces as the principal leeward bank blocks, and the principal communicating spaces and the principal leeward bank blocks form mutually different pairs, in each of which the principal communicating space communicates with the flat tubes constituting the principal leeward bank block.

18. The heat exchanger of claim 2, wherein the auxiliary windward bank portion is further divided into a plurality of auxiliary windward bank blocks, each of which being constituted of the plurality of the flat tubes arranged one above the other, the auxiliary leeward bank portion is further divided into a plurality of auxiliary leeward bank blocks, each of which being constituted of the plurality of flat tubes arranged one above the other, the number of the auxiliary windward bank blocks is equal to the number of the auxiliary leeward bank blocks, the auxiliary windward bank blocks and the auxiliary leeward bank blocks form mutually different pairs, and the auxiliary windward bank block and the auxiliary leeward bank block in each of the mutually different pairs are arranged in series in the refrigerant flow path.

19. The heat exchanger of claim 18, wherein the header collecting pipe is further formed with a plurality of auxiliary communicating spaces each communicating with the flat tubes constituting the auxiliary leeward bank portion, the number of the auxiliary communicating spaces is equal to the number of the auxiliary leeward bank blocks, each of the auxiliary leeward bank blocks is paired with an associated one of the auxiliary communicating spaces, and in each of the pairs of the auxiliary communicating spaces and the auxiliary leeward bank blocks, the auxiliary communicating space communicates with the flat tubes constituting the auxiliary leeward bank block.

20. The heat exchanger of claim 2, wherein the principal leeward bank portion is further divided into a plurality of principal leeward bank blocks, each of which being constituted of the plurality of flat tubes arranged one above the other, the auxiliary leeward bank portion is further divided into a plurality of auxiliary leeward bank blocks, each of which being constituted of the plurality of flat tubes arranged one above the other, the header collecting pipe is formed with as many the principal communicating spaces as the principal leeward bank blocks, and the principal communicating spaces and the principal leeward bank blocks form mutually different pairs, in each of which the principal communicating space communicates with the flat tubes constituting the principal leeward bank block.

* * * * *